US011448456B2

(12) United States Patent
Oh et al.

(10) Patent No.: US 11,448,456 B2
(45) Date of Patent: Sep. 20, 2022

(54) ENTRANCE REFRIGERATOR

(71) Applicant: LG ELECTRONICS INC., Seoul (KR)

(72) Inventors: Minkyu Oh, Seoul (KR); Insun Yeo, Seoul (KR); Kyukwan Choi, Seoul (KR); Yezo Yun, Seoul (KR); Deukwon Lee, Seoul (KR); Minseok Kim, Seoul (KR); Wonjin Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 219 days.

(21) Appl. No.: 16/798,843

(22) Filed: Feb. 24, 2020

(65) Prior Publication Data

US 2020/0271377 A1 Aug. 27, 2020

(30) Foreign Application Priority Data

Feb. 25, 2019 (KR) ..... 10-2019-0021867
Jul. 23, 2019 (KR) ..... 10-2019-0089221

(51) Int. Cl.

| | |
|---|---|
| ***F25D 23/10*** | (2006.01) |
| ***F25D 23/02*** | (2006.01) |
| ***F25D 29/00*** | (2006.01) |
| ***F25B 21/02*** | (2006.01) |
| *F25B 25/02* | (2006.01) |

(52) U.S. Cl.

CPC ..... *F25D 23/10* (2013.01); *F25D 23/028* (2013.01); *F25D 29/005* (2013.01); *F25B 21/02* (2013.01); *F25B 25/02* (2013.01); *F25D 2700/00* (2013.01)

(58) Field of Classification Search

CPC ..... F25B 21/02; F25D 23/10; F25D 25/02; F25D 25/021; F25D 25/024

See application file for complete search history.

(56) References Cited

U.S. PATENT DOCUMENTS

| | | | | |
|---|---|---|---|---|
| 3,078,682 A | | 2/1963 | Gould | |
| 3,177,678 A | | 4/1965 | Facey, Jr. | |
| 4,726,193 A | | 2/1988 | Burke et al. | |
| 4,738,113 A | | 4/1988 | Rudick | |
| 5,315,830 A | | 5/1994 | Doke et al. | |
| 5,774,053 A | * | 6/1998 | Porter | A47G 29/141 340/568.1 |

(Continued)

FOREIGN PATENT DOCUMENTS

| | | |
|---|---|---|
| CA | 2461635 A1 | 9/2005 |
| CN | 2165389 Y | 5/1994 |

(Continued)

OTHER PUBLICATIONS

Chinese Office Action and Search Report for Chinese Application No. 202010110989.7, dated May 26, 2021.

(Continued)

*Primary Examiner* — Lionel Nouketcha

(74) *Attorney, Agent, or Firm* — Birch, Stewart, Kolasch & Birch, LLP

(57) ABSTRACT

In an entrance refrigerator, when a living organism such as a companion animal is detected in a storage compartment, a drain port provided at the bottom of the storage compartment is opened, such that air outside the storage compartment flows into the storage compartment through the drain port.

13 Claims, 16 Drawing Sheets

(56) References Cited

U.S. PATENT DOCUMENTS

| | | | | |
|---|---|---|---|---|
| 7,308,796 | B1 | 12/2007 | Eager | |
| 7,934,384 | B2 | 5/2011 | Tuskiewicz et al. | |
| 2003/0084670 | A1 | 5/2003 | Kim et al. | |
| 2004/0210153 | A1 | 10/2004 | Tsukashima et al. | |
| 2005/0122682 | A1 | 6/2005 | Streit | |
| 2005/0210884 | A1* | 9/2005 | Tuskiewicz | F25D 17/06 62/3.6 |
| 2007/0273475 | A9 | 11/2007 | Neumann | |
| 2017/0213187 | A1 | 7/2017 | Choi et al. | |
| 2017/0251833 | A1 | 9/2017 | Stolarz et al. | |
| 2018/0087822 | A1 | 3/2018 | Han et al. | |
| 2018/0087824 | A1 | 3/2018 | Han et al. | |
| 2018/0187944 | A1 | 7/2018 | Park et al. | |
| 2018/0283765 | A1 | 10/2018 | Yi et al. | |
| 2019/0033897 | A1 | 1/2019 | Barbier | |

FOREIGN PATENT DOCUMENTS

| | | | | |
|---|---|---|---|---|
| CN | 101210760 | A | | 7/2008 |
| CN | 201277783 | Y | | 7/2009 |
| CN | 102589236 | A | | 7/2012 |
| CN | 102914119 | A | | 2/2013 |
| CN | 102927748 | A | | 2/2013 |
| CN | 203534032 | U | | 4/2014 |
| CN | 105389944 | A | | 3/2016 |
| CN | 206257869 | U | | 6/2017 |
| CN | 206362072 | U | | 7/2017 |
| CN | 107084583 | A | * | 8/2017 |
| CN | 107440482 | A | | 12/2017 |
| CN | 207006712 | U | | 2/2018 |
| CN | 108344233 | A | | 7/2018 |
| CN | 108458540 | A | | 8/2018 |
| CN | 108471893 | A | | 8/2018 |
| CN | 207922675 | U | | 9/2018 |
| CN | 207922676 | U | | 9/2018 |
| CN | 108882798 | A | | 11/2018 |
| CN | 108917256 | A | | 11/2018 |
| EP | 1004487 | B1 | | 6/2005 |
| EP | 2980511 | A1 | | 2/2016 |
| FR | 1347414 | A | | 11/1963 |
| JP | 5-149675 | A | | 6/1993 |
| JP | 10-267501 | A | | 10/1998 |
| JP | 11-94423 | A | | 4/1999 |
| JP | 2017-198360 | A | | 11/2017 |
| KR | 10-2011-0033394 | A | | 3/2011 |
| TW | 499559 | B | | 8/2002 |
| WO | WO 97/41542 | A1 | | 11/1997 |
| WO | WO 2006/087690 | A2 | | 8/2006 |
| WO | WO 2011/107884 | A2 | | 9/2011 |
| WO | WO 2018/131076 | A1 | | 7/2018 |

OTHER PUBLICATIONS

Chinese Office Action and Search Report for Chinese Application o. 202010111000.4, dated Jul. 5, 2021.

Chinese Office Action and Search Report for Chinese Application No. 202010106017.0 dated Jun. 25, 2021.

Chinese Office Action and Search Report for Chinese Application No. 2020101077774.X, dated May 26, 2021.

Chinese Office Action and Search Report for Chinese Application No. 202010107501.5, dated Jun. 1, 2021.

U.S. Office Action for U.S. Appl. No. 16/798,962, dated Oct. 21, 2021.

U.S Office Action dated Apr. 4, 2022 for U.S. Appl. No. 16/798,617.

U.S. Office Action for U.S. Appl. No. 16/798,778, dated Jun. 14, 2022.

U.S. Notice of Allowance for U.S. Appl. No. 16/798,683, dated May 10, 2022.

* cited by examiner

ENTRANCE REFRIGERATOR

CROSS-REFERENCE TO RELATED APPLICATIONS

The present application claims the benefits of priority to Korean Patent Application No. 10-2019-0021867, filed on Feb. 25, 2019, and Korean Patent Application No. 10-2019-0089221, filed on Jul. 23, 2019, all of which are herein incorporated by reference in their entireties.

BACKGROUND

The present disclosure relates to a refrigerator installed at an entrance of a building, such as a home or a business.

Recently, delivery services for delivering fresh goods to predetermined places are being utilized. In particular, when the goods are fresh food, a delivery vehicle is provided with a refrigerator or a warmer to store and deliver the food so as to prevent the food from spoiling or cooling.

Generally, the food is packed in a packaging material and delivered so as to keep the food cool or warm, depending on the type of food. The packaging material is often composed of environmental pollutants such as polystyrene foam. The social atmosphere recently has placed an emphasis on a reduction of an amount of packaging material used.

When a user is at home at the time of a delivery, the delivery person may deliver the food to the user in a face-to-face manner. However, when the user is not at home or when the delivery time is too early or too late, it is difficult for the delivery person to deliver the food in a face-to-face manner.

Therefore, there is a need to be able to deliver the food even if the delivery person does not face the user, and to prevent the food from spoiling or cooling until the food is finally delivered to the user.

To solve this problem, in recent years, a product has been introduced in which a refrigerator is installed at an entrance (e.g. a front door) of a predetermined place, so that a delivery person can deliver the food into the refrigerator in order to keep the food fresh until a user can receive the food by accessing the refrigerator at a convenient time.

Korean Patent Application Publication No. 2011-0033394 (Mar. 31, 2011) discloses an entrance refrigerator mounted on a front door.

The conventional entrance refrigerator disclosed in the prior art has several problems.

The occurrence of a pet or other animal entering into a storage compartment of an entrance refrigerator is not common, but the possibility of such an occurrence should be considered. Furthermore, a situation should be considered in which a user or a delivery person does not notice that an animal is in a storage compartment and closes an outdoor side door or an indoor side door.

When the storage compartment is kept closed for a long time, an animal trapped in the storage compartment may die due to a lack of oxygen and a decrease in body temperature.

SUMMARY

The present disclosure has been proposed as a solution to the above-described problems.

An object of the present disclosure is to provide an entrance refrigerator capable of preventing a lack of oxygen in a storage compartment from occurring if a companion animal is trapped in the storage compartment.

In an entrance refrigerator, when a living organism such as a companion animal is detected in a storage compartment, a drain port provided at the bottom of the storage compartment is opened, such that air outside the storage compartment flows into the storage compartment through the drain port.

To this end, a carbon dioxide sensor for detecting the concentration of carbon dioxide discharged by the companion animal or a motion sensor for detecting the motion of the companion animal may be mounted inside the storage compartment.

When the lower end of the drain port is maintained in a state of being immersed in condensed water, air outside the storage compartment does not flow into the storage compartment through the drain port. Therefore, an air hole may be formed on the side surface of the drain port to be selectively opened or closed by an actuator.

The actuator, which selectively opens or closes the air hole, may include a driver and a plunger which performs a linear reciprocating motion by the driver, so that the end of the plunger may selectively open or close the air hole.

When a controller of the entrance refrigerator determines that a concentration of carbon dioxide detected by a carbon dioxide sensor is greater than or equal to a set value, or a living organism is detected in the entrance refrigerator by a motion sensor, the actuator may be driven to open the air hole.

As another method, a drain cover for shielding a condensed water discharge port formed in the lower end of the drain port may be provided, and the drain cover may allow the actuator to selectively open the condensed water discharge port.

That is, when it is determined that the living organism is present in the storage compartment, the controller may allow the plunger of the actuator to press down a shielding plate constituting the drain cover, such that the condensed water discharge port is opened.

In other situations, the condensed water discharge port may be opened by rotation of the shielding plate due to the load of the condensed water collected in the drain port. When the condensed water is discharged, the shielding plate may be restored to an original position by a restoring force of a torsion spring mounted on a rotational shaft of the shielding plate.

The entrance refrigerator configured as described above according to the embodiment has the following effects.

In detail, when the living organism, such as a companion animal, is detected in the storage compartment, a condensed water flow passage provided for discharging condensed water generated in the bottom of the storage compartment or a cold sink of a thermoelectric module may be opened.

Since oxygen is continuously supplied to the storage compartment, an occurrence in which the companion animal dies due to the lack of oxygen may be prevented.

In addition, when the living organism, such as a companion animal, is detected in the storage compartment, the driving of the cold air supply device may be controlled to adjust the temperature of the storage compartment. Therefore, an occurrence in which the companion animal dies due to hypothermia may be prevented.

The details of one or more embodiments are set forth in the accompanying drawings and the description below. Other features will be apparent from the description and drawings, and from the claims.

DETAILED DESCRIPTION OF THE EMBODIMENTS

Hereinafter, an entrance refrigerator 10 according to an embodiment will be described in detail with reference to the accompanying drawings.

Figure 1:
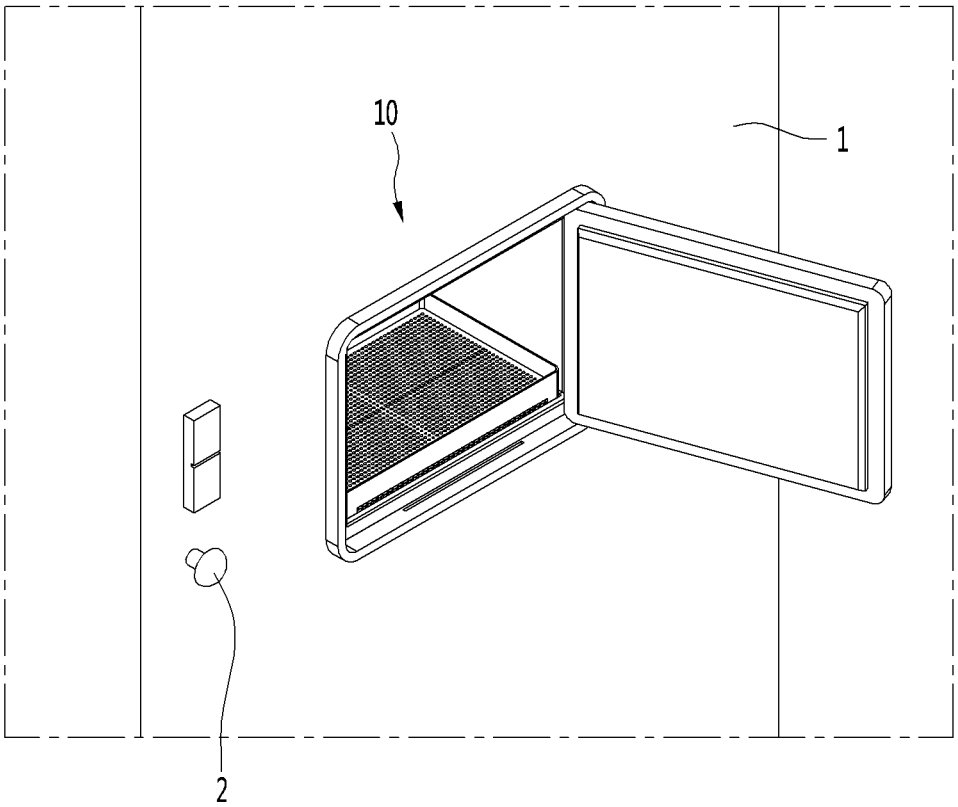
FIG. 1 is a front view of an entrance refrigerator installed at a front door, according to an embodiment.
Figure 2:
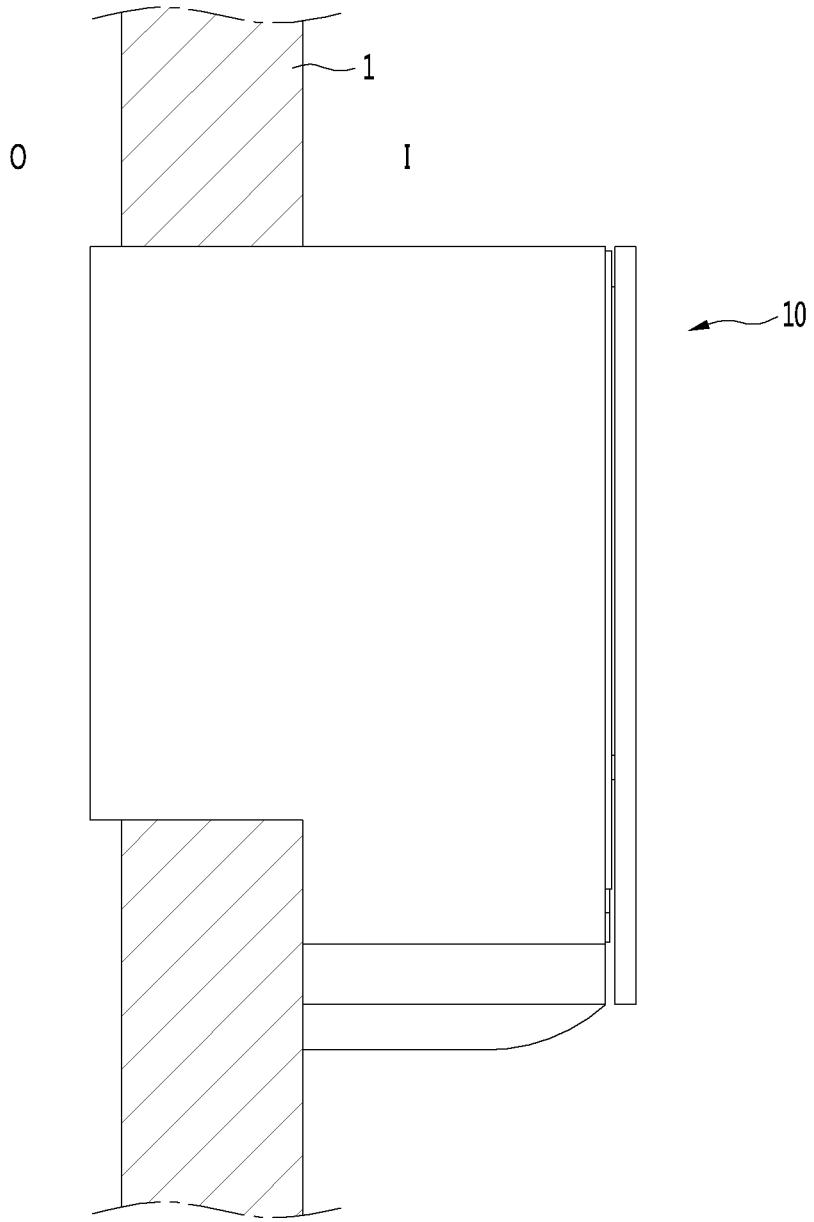
FIG. 2 is a side view of the entrance refrigerator installed at the front door, according to an embodiment.

FIG. 1 is a front view of an entrance refrigerator 10 according to an embodiment installed at a front door of a building, such as a residence, and FIG. 2 is a side view of the entrance refrigerator 10 installed at the front door, according to an embodiment.

Referring to FIGS. 1 and 2, the entrance refrigerator 10 according to the embodiment may be mounted by passing through a suitably-sized opening in a front door 1 or a front wall of a house.

In detail, the entrance refrigerator 10 may be mounted at a point spaced apart from a knob 2 of the front door 1, for example, the entrance refrigerator 10 may be mounted at the center of the front door 1.

In addition, the entrance refrigerator 10 is preferably installed at a height within two meters from the bottom of the front door 1 for convenience of a user and for convenience to a delivery person who delivers goods to the entrance refrigerator 10. Preferably, the entrance refrigerator 10 may be installed at a height in a range of 1.5 meters to 1.7 meters from the bottom of the front door 1.

One portion of the entrance refrigerator 10 is exposed to the outside O (outdoors), and another portion of the entrance refrigerator 10 is exposed to the inside I (indoors). For example, in the entrance refrigerator 10, the surface exposed to the outside O may be defined as the front surface (or outdoor portion) at the front side (exterior side) of the door or wall, and the surface exposed to the inside I may be defined as the rear surface (or indoor portion) at the rear side (interior side) of the door or wall. The door or wall provides a barrier in or around a building, such as, but not limited to, a house, apartment, office, hospital, or the like.

Hereinafter, the configuration of the entrance refrigerator 10 according to the embodiment will be described in more detail with reference to the accompanying drawings.

Figure 3:
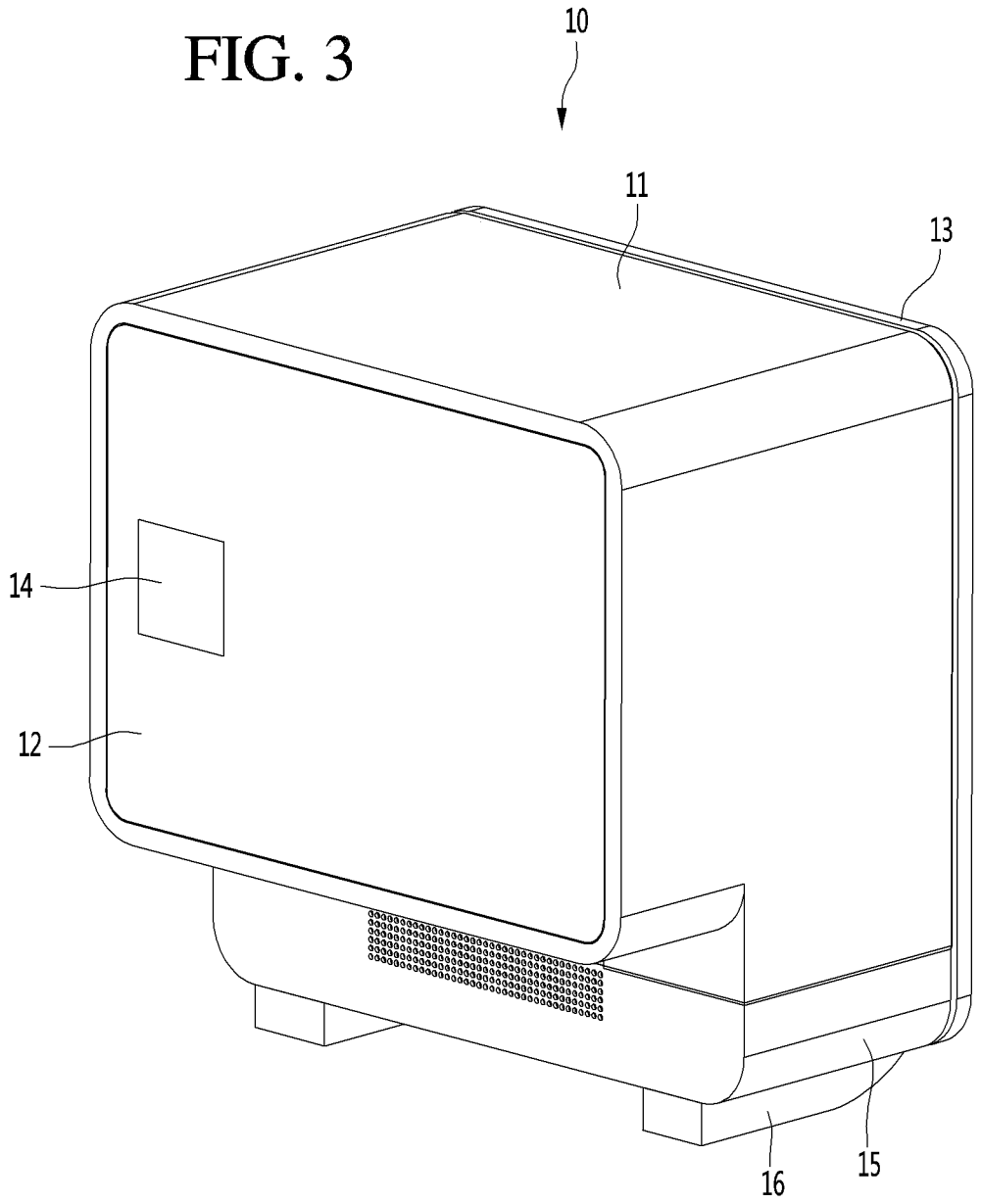
FIG. 3 is a front perspective view of the entrance refrigerator according to an embodiment.
Figure 4:
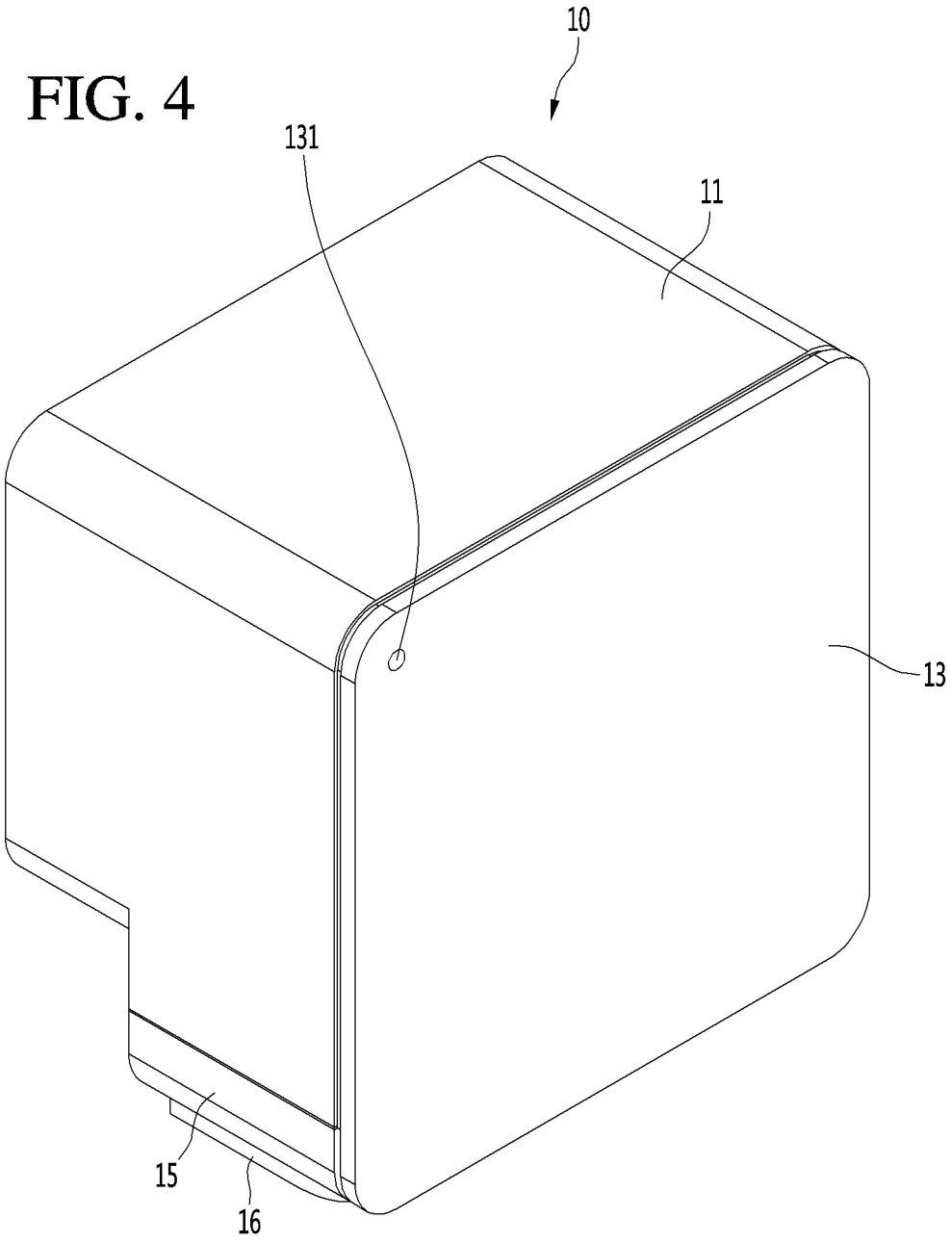
FIG. 4 is a rear perspective view of the entrance refrigerator according to an embodiment.
Figure 5:
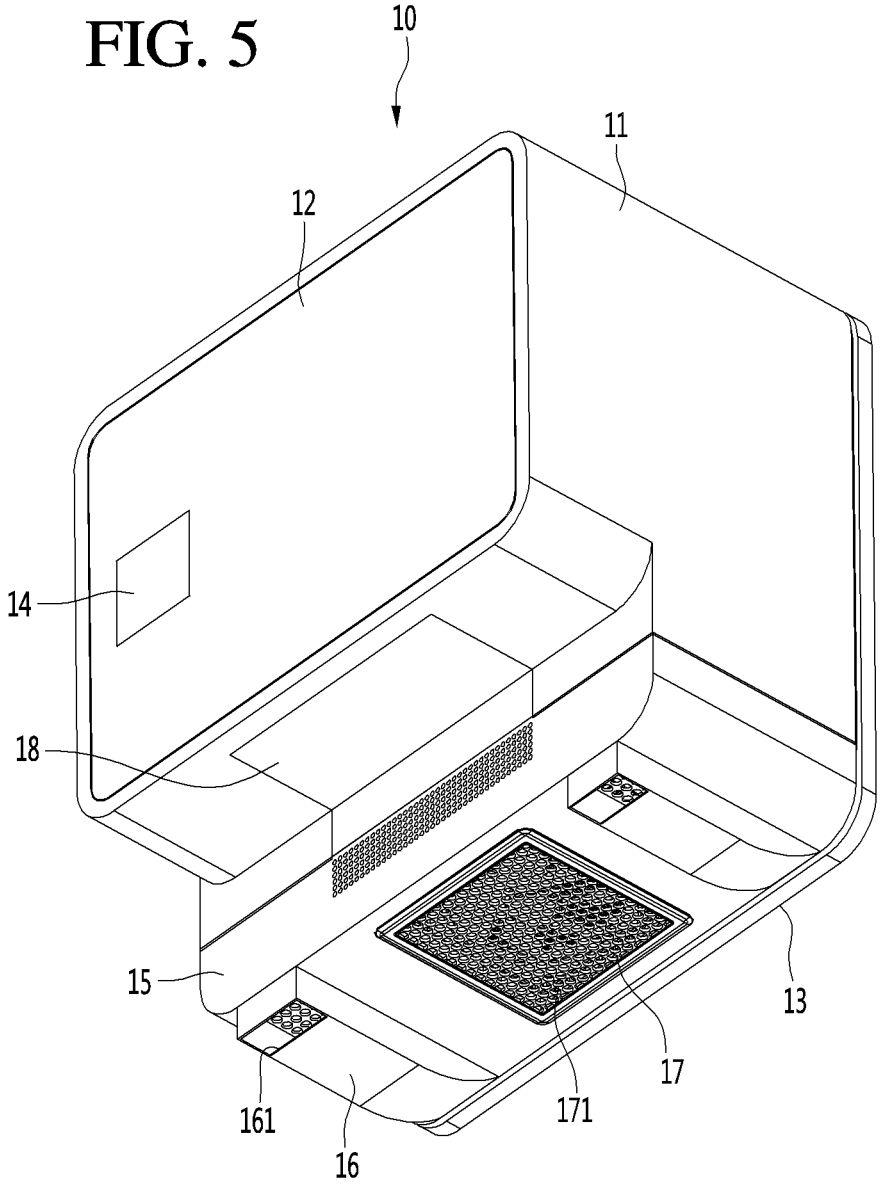
FIG. 5 is a bottom perspective view of the entrance refrigerator according to an embodiment.

FIG. 3 is a front perspective view of the entrance refrigerator 10 according to an embodiment, FIG. 4 is a rear perspective view of the entrance refrigerator 10, and FIG. 5 is a bottom perspective view of the entrance refrigerator 10.

Referring to FIGS. 3 to 5, the entrance refrigerator 10 according to the embodiment may include a cabinet 11, an outdoor side door 12, an indoor side door 13, and a housing 15.

The cabinet 11 has a front opening provided in a portion of the cabinet 11 located at the front (exterior) side of the door or exterior wall, and a rear opening provided in a portion of the cabinet 11 located at the rear (interior) side of the door or interior wall. The cabinet 11 may have an approximately hexahedral shape with a front wall and a rear wall interconnected by a plurality of side walls. The front opening may be provided in the front wall of the cabinet 11, and the rear opening may be provided in the rear wall of the cabinet 11, although the embodiment is not limited thereto. For example, the front opening and the rear opening may be provided on a same side of the cabinet 11 depending on the location where the entrance refrigerator 10 is being installed. The outdoor side door 12 may be rotatably coupled to the cabinet 11 so as to selectively open or close the front opening of the cabinet 11. The outdoor side door 12 may be opened by the delivery person in order to store goods in the entrance refrigerator 10. In addition, the outdoor side door 12 may be opened by the user so as to withdraw goods from the entrance refrigerator 10.

Here, the term "user" is defined as a person who has ordered goods that are stored in the entrance refrigerator 10 by the delivery person, or as a person having authority to release the goods from the entrance refrigerator 10.

In addition, the indoor side door 13 may be rotatably coupled to the cabinet 11 so as to selectively open or close the rear opening of the cabinet 11.

A display 14 may be provided on the outdoor side door 12. The display 14 may display information about an operating state of the entrance refrigerator 10, an internal temperature of the entrance refrigerator 10, and the presence or absence of goods in the entrance refrigerator 10.

In addition, the delivery person who delivers goods may input a password or the like through the display 14 for opening the outdoor side door 12.

A code scanner for recognizing an encryption code provided in a shipping order or a shipping box may be provided on one side of the outdoor side door 12.

The indoor side door 13 is used by the user within the house to take out goods stored in the entrance refrigerator 10. That is, the user can open the indoor side door 13 to withdraw the goods from the entrance refrigerator 10 and into the house.

A guide light 131 may be provided at one side of the indoor side door 13. The guide light 131 may be a device for informing a user whether or not goods are currently stored in the entrance refrigerator 10. For example, the color of the guide light 131 may be set differently depending on whether goods are stored in the entrance refrigerator 10 or whether the entrance refrigerator 10 is empty. The user may recognize whether there are goods currently being stored even without opening the indoor side door 13.

The housing 15 is provided at the lower end of the cabinet 11, either integrally as part of the cabinet 11 or as a separate element attached to the cabinet 11. A cold air supply device 30 (cold air supplier), to be described later, is accommodated in the housing 15. The front surface of the housing 15 comes into close proximity with the rear surface of the front door 1 or the wall when the entrance refrigerator 10 is mounted on the front door 1 or the wall, and contact between a portion of the front surface of the housing 15 and the rear surface of the front door 1 or the wall cancels the moment due to the eccentric load of the entrance refrigerator 10 within the opening of the front door 1 or the wall.

In detail, the entrance refrigerator 10 according to the embodiment has a structural characteristic in which a volume of a part exposed indoors is larger than a volume of a part exposed outdoors of the front door 1. Therefore, the center of gravity of the entrance refrigerator 10 is formed at a point eccentric rearwardly of the center of the entrance refrigerator 10. As a result, the moment is generated by the load of the entrance refrigerator 10 and the load of goods stored therein. With such an arrangement, it is possible that the entrance refrigerator 10 could be pulled out of the front door 1 by the moment.

However, since the front surface of the housing 15 contacts the rear surface of the front door 1 or the wall, the moment acting on the entrance refrigerator 10 is cancelled, thereby preventing the entrance refrigerator 10 from being separated from the front door 1.

A pair of guide ducts 16 may be provided at left and right edges of the bottom surface of the housing 15. A discharge port 161 is formed at the front end of each guide duct 16 so that indoor room air, which flows into the cold air supply device 30 in the housing 15 and performs a heat dissipation function, may be discharged out of the housing 15.

A guide plate 18 may be provided on an angled surface of the cabinet 11 formed by the bottom surface of the cabinet 11 and the front surface of the housing 15. The function of the guide plate 18 will be described below with reference to the accompanying drawings.

An opening for suctioning indoor room air may be formed in the bottom surface of the housing 15, and a suction plate 17 may be mounted at the opening. A plurality of through-holes 171 may be formed in the suction plate 17, and indoor room air is introduced into the housing 15 through the plurality of through-holes 171. At least part of the indoor room air introduced into the housing 15 is discharged back out of the housing 15 through the discharge ports 161 of the guide ducts 16.

Figure 6:
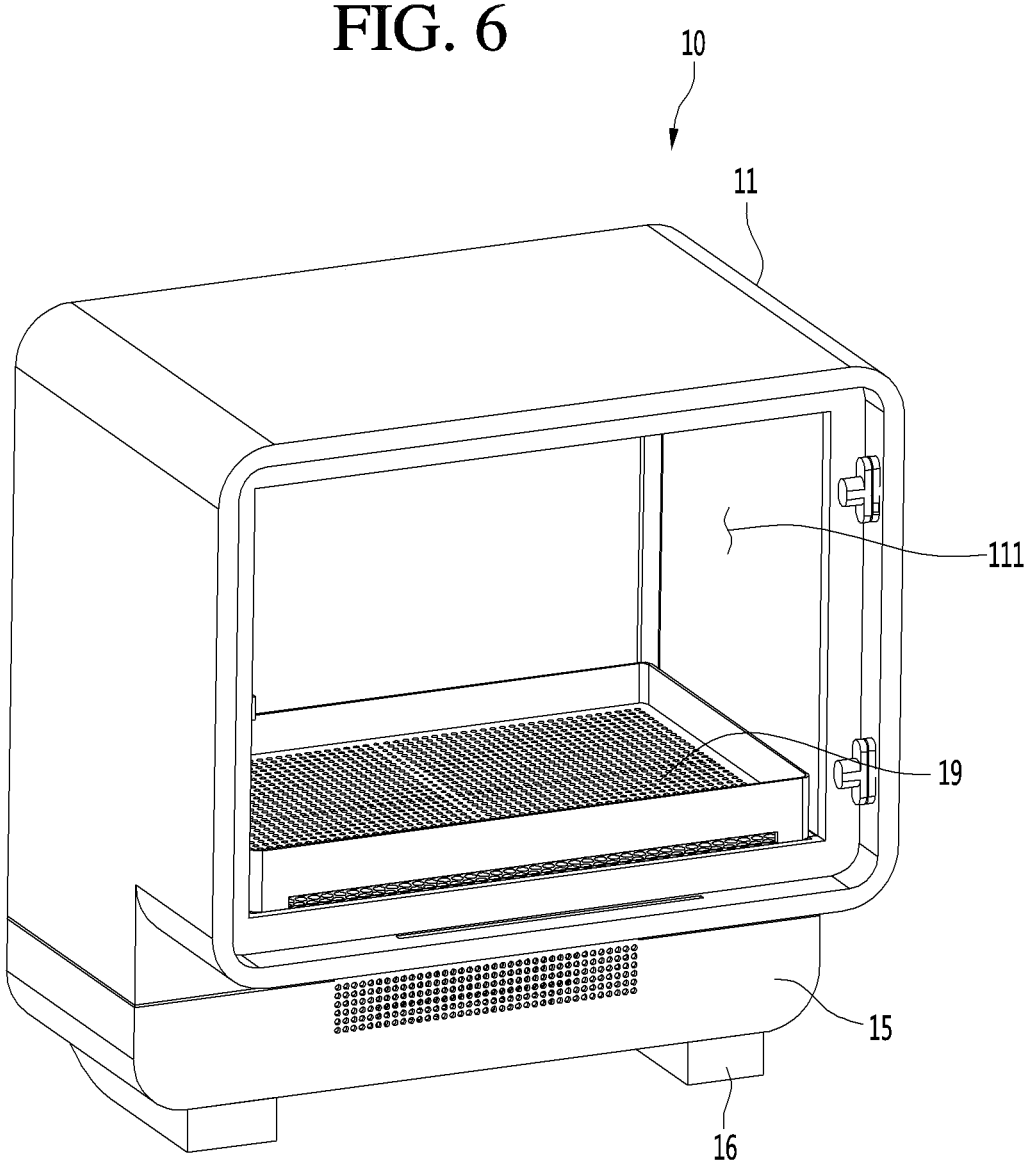
FIG. 6 is a front perspective view of the entrance refrigerator in a state in which an outdoor side door is removed for clarity of illustration, according to an embodiment.
Figure 7:
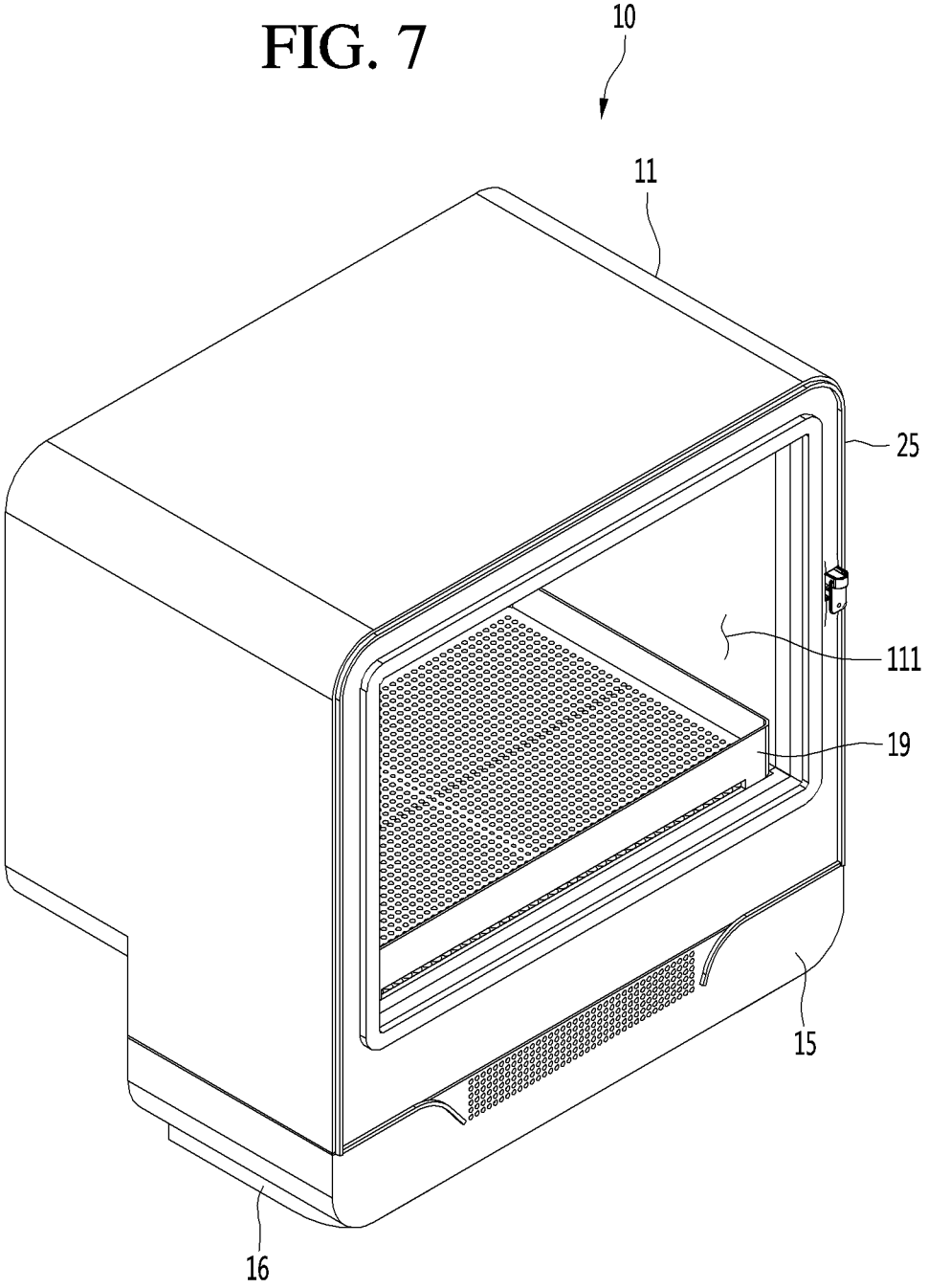
FIG. 7 is a rear perspective view of the entrance refrigerator in a state in which an indoor side door is removed for clarity of illustration, according to an embodiment.

FIG. 6 is a front perspective view of the entrance refrigerator 10 in a state in which the outdoor side door 12 is removed for clarity of illustration, according to an embodiment, and FIG. 7 is a rear perspective view of the entrance refrigerator 10 in a state in which the indoor side door 13 is removed for clarity of illustration, according to an embodiment.

Referring to FIGS. 6 and 7, a storage compartment 111 in which goods may be stored is provided within the cabinet 11. The storage compartment 111 may be considered as a main body of the entrance refrigerator 10 according to the embodiment.

A tray 19 on which goods are placed may be provided at a lower portion of the storage compartment 111.

In addition, a guide rib 25 may be formed along the rear edge of the cabinet 11. The guide rib 25 may protrude a predetermined distance from the rear surface of the cabinet 11 and extend along an edge of the cabinet 11. The guide rib 25 is provided to guide some of the air discharged from the housing 15 upwardly to the area surrounding the indoor side door 13 so that condensation is prevented from forming on a gasket 22 surrounding the rear surface of the indoor side door 13.

Figure 8:
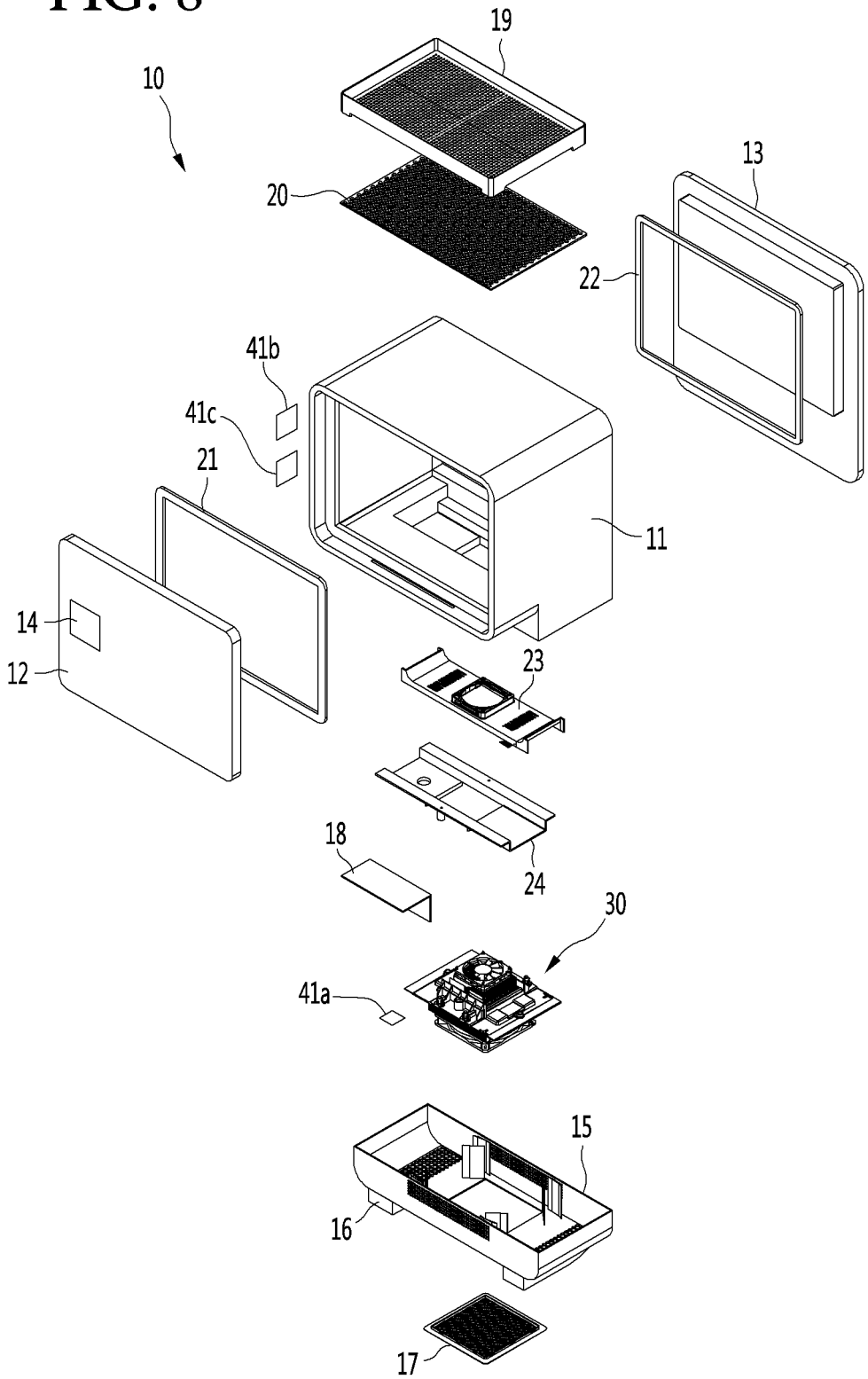
FIG. 8 is an exploded perspective view of the entrance refrigerator according to an embodiment.

FIG. 8 is an exploded perspective view of the entrance refrigerator 10 according to an embodiment.

Referring to FIG. 8, as described above, the entrance refrigerator 10 according to the embodiment may include the cabinet 11, the indoor side door 13, the outdoor side door 12, the housing 15, the guide duct 16, the suction plate 17, and the tray 19.

The entrance refrigerator 10 may further include a base plate 20 disposed at the bottom portion of the cabinet 11. The tray 19 may be disposed above the base plate 20. The bottom surface of the tray 19 may be spaced apart upward from the base plate 20.

The entrance refrigerator 10 may further include a cold air supply device 30 accommodated in the housing 15.

The cold air supply device 30 may be a device to which a thermoelectric element (Peltier element) is applied, but the cold air supply device 30 is not limited thereto. For example, a general cooling cycle may be applied to the cold air supply device 30.

When a current is supplied to the thermoelectric element, one surface thereof acts as a heat absorbing surface in which a temperature drops, and the other surface thereof acts as a heat generating surface in which a temperature increases. In addition, when the direction of the current supplied to the thermoelectric element is changed, the heat absorbing surface and the heat generating surface are swapped.

The structure and function of the cold air supply device will be described in more detail with reference to the accompanying drawings.

The entrance refrigerator 10 may further include a mount plate 24 mounted on the bottom of the cabinet 11, and a flow guide 23 mounted on the upper surface of the mount plate 24.

In addition, the flow guide 23 may be understood as a device for forming the flow passage of the air inside the storage compartment 111 which forcibly flows by the heat absorption fan 33.

The base plate 20 may be disposed above the flow guide 23 to minimize a possibility that foreign substances could fall directly onto the flow guide 23.

An outer gasket 21 is provided on an inner side of the outdoor side door 12 that faces the cabinet 11, and an inner gasket 22 is provided on an inner side of the indoor side door 13 that faces the cabinet 11. The outer gasket 21 and the inner gasket 22 prevent cold air within the storage compartment 111 from leaking to the outside of the entrance refrigerator 10. Alternatively, the outer gasket 21 may be provided on a portion of the cabinet 11 that faces an inner side of the outdoor side door 12, and the inner gasket 22 may be provided on a portion of the cabinet 11 that faces an inner side of the indoor side door 13. The portion of the cabinet 11 may be a contact shoulder 115 to be described later. The outer gasket 21 and the inner gasket 22 prevent cold air within the storage compartment 111 from leaking to the outside of the entrance refrigerator 10.

Figure 9:
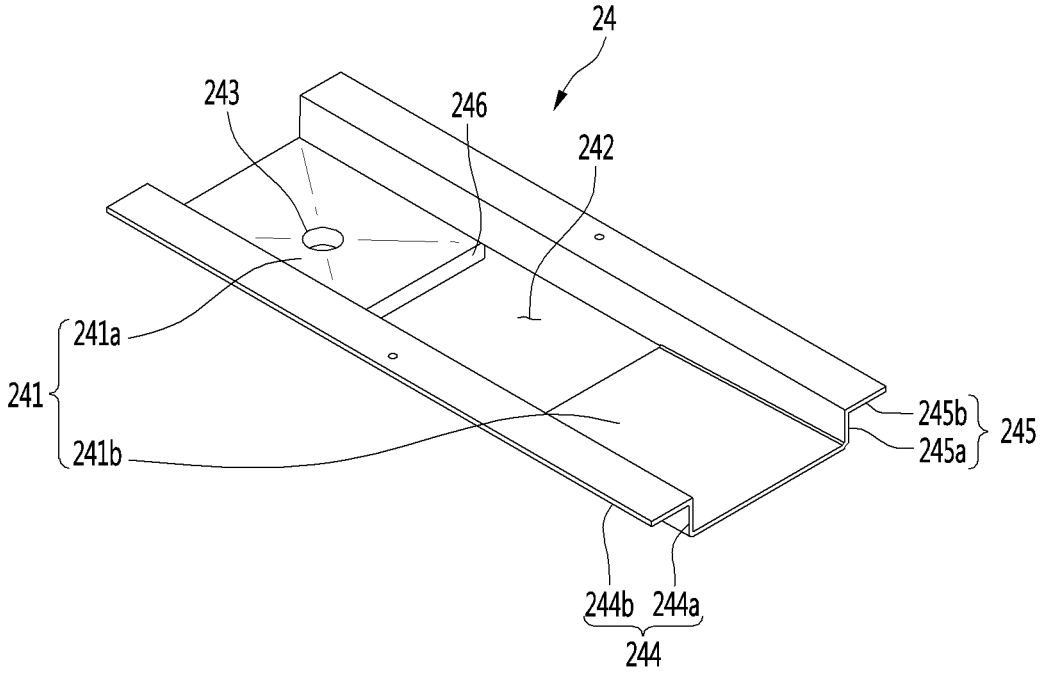
FIG. 9 is a perspective view of a mount plate of the entrance refrigerator, according to an embodiment.

FIG. 9 is a perspective view of a mount plate of the entrance refrigerator 10, according to an embodiment.

Referring to FIG. 9, the mount plate 24 according to the embodiment may have a shape in which a rectangular plate is bent a plurality of times.

In detail, the mount plate 24 may include a flow guide seating portion 241, a front flange 244, and a rear flange 245.

The flow guide 23 is disposed directly above the flow guide seating portion 241, and a space formed between the flow guide 23 and the flow guide seating portion 241 may be defined as a cold air supply flow passage. The temperature of the cold air flowing due to the heat absorption fan 33 is lowered while passing through the cold sink 32. The cold air is distributed to the left and right sides of the cold sink 32 and flows into the bottom left and bottom right sides of the storage compartment 111 along the cold air supply flow passage.

A through-hole 242 may be formed in the center of the flow guide seating portion 241, and part of the cold air supply device 30 may pass through the through-hole 242 and be mounted therein. In detail, the cold sink 32 is disposed in the through-hole 242, such that the cold air passing through the cold sink 32 and the water formed on the cold sink 32 flow to the flow guide seating portion 241. The flow of cold air passing through the cold sink 32 and the flow of condensation formed on the surface of the cold sink 32 will be described in more detail with reference to the accompanying drawings.

The flow guide seating portion 241 may include a left flow guide seating portion 241*a* formed at the left side of the through-hole 242 and a right flow guide seating portion 241*b* formed at the right side of the through-hole 242.

In addition, a drain hole 243 may be formed in either or both of the left flow guide seating portion 241*a* and the right flow guide seating portion 241*b*. An example in which the drain hole 243, and the drain port and the drain box, which will be described later, are provided only at the left side of the through-hole 242 is described herein, but it is noted that the same may also be provided on the right side of the through-hole 242. However, for convenience of description, an example in which they are formed only at the left side of the through-hole 242 is described below.

In addition, the bottom portion in which the drain hole 243 is formed, that is, the left flow guide seating portion 241*a* in the present embodiment, is formed to be slanted to direct water toward the drain hole 243.

That is, the left edge and the right edge of the left flow guide seating portion 241*a* are preferably designed to be higher than the drain hole 243. Similarly, the front end and the rear end of the left flow guide seating portion 241*a* may be designed to be higher than the drain hole 243.

The front flange 244 may include a vertical portion 244*a* extending upward from a front end of the flow guide seating portion 241, and a horizontal portion 244*b* extending forward from the upper end of the vertical portion 244*a*. The vertical portion 244*a* does not necessarily need to be perpendicular to the horizontal plane, and the horizontal portion 244*b* does not necessarily need to be the same plane as the horizontal plane. In other words, the front flange 244 is sufficient to be bent along contours of a seating shoulder 111*d* (see FIG. 16) formed at the bottom of the cabinet 11.

Similarly, the rear flange 245 may also include a vertical portion 245*a* and a horizontal portion 245*b* so as to be seated on the seating shoulder 111*d*. The vertical portion 245*a* of the rear flange 245 does not necessarily need to be perpendicular to the horizontal plane, and the horizontal portion 245*b* does not necessarily need to be the same plane as the horizontal plane.

Guide ribs 246 may extend downward from the left edge and the right edge of the through-hole 242, respectively, to assist with holding the cold air supply device 30 in place.

Figure 10:
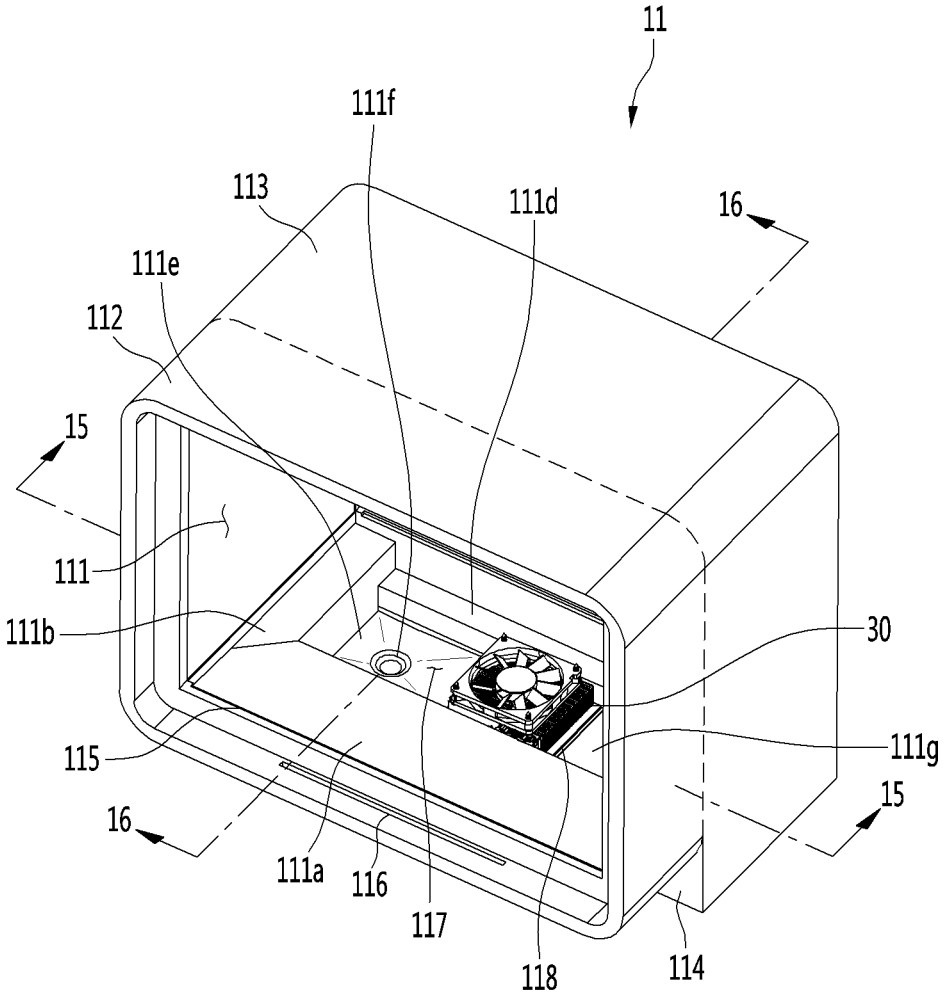
FIG. 10 is a perspective view of a cabinet constituting the entrance refrigerator, according to an embodiment.
Figure 11:
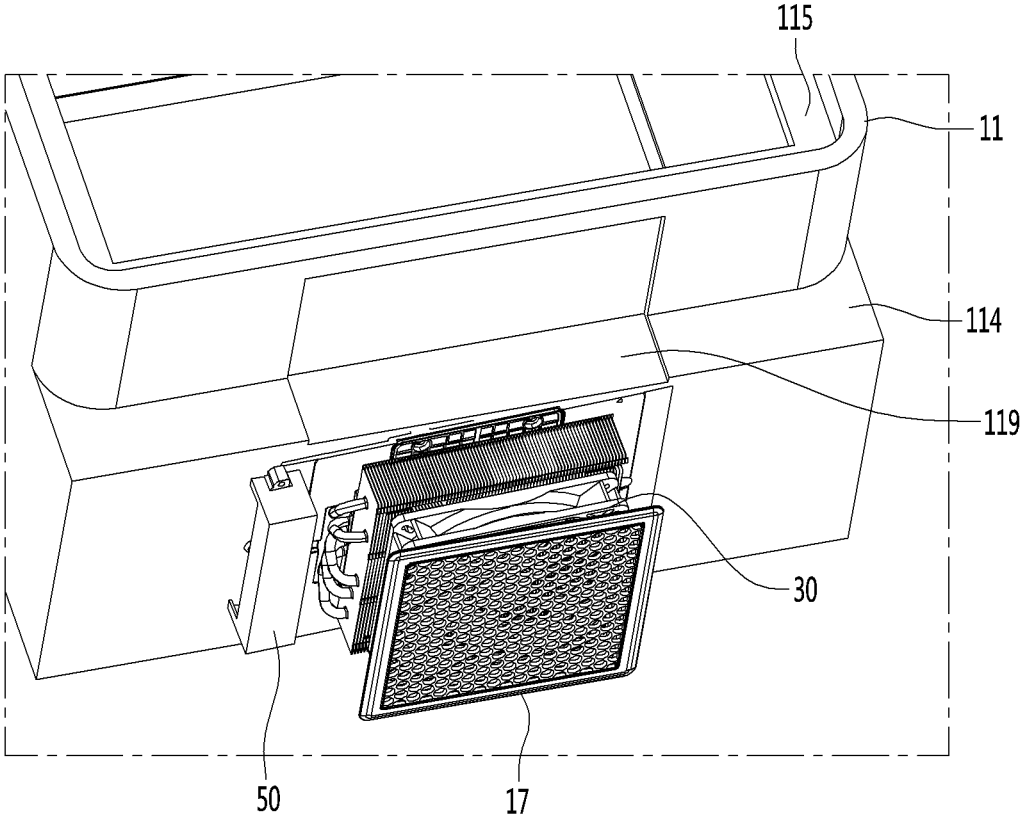
FIG. 11 is a partial perspective view illustrating the bottom surface of the cabinet on which a drain box is mounted.
Figure 12:
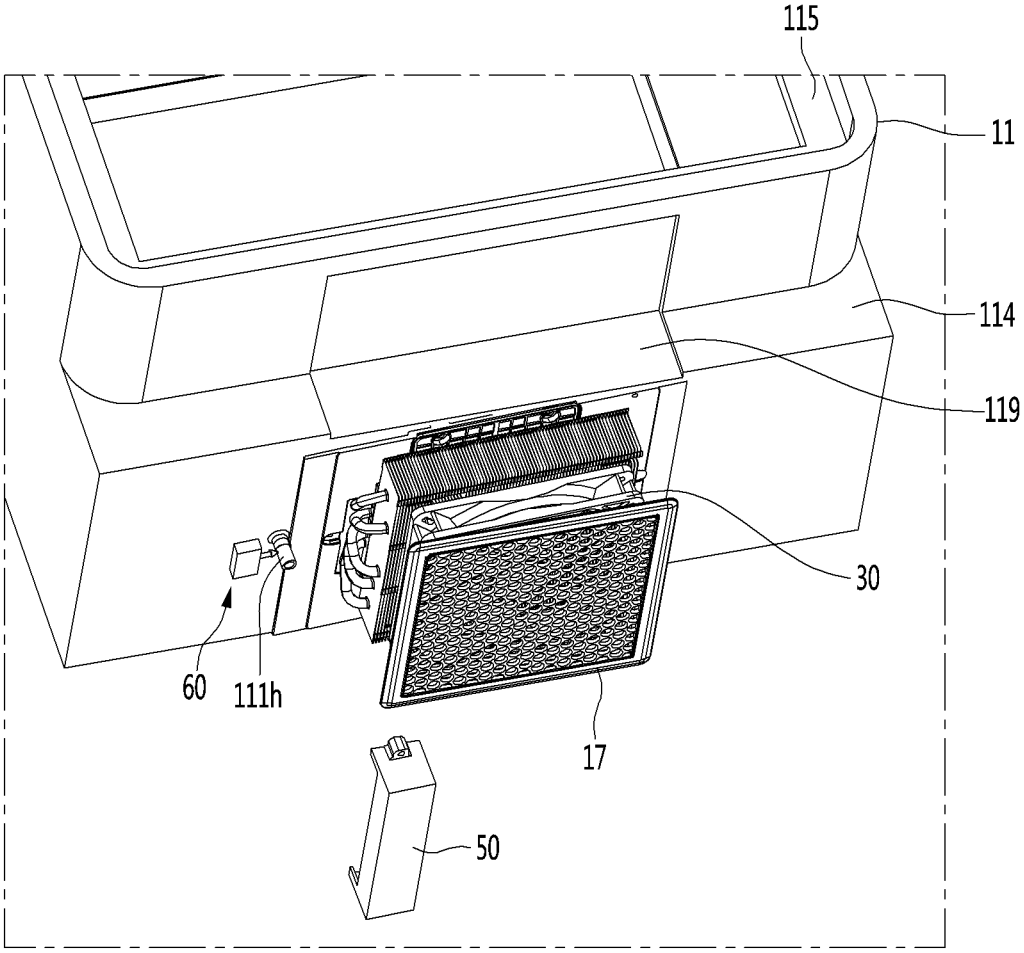
FIG. 12 is a partial perspective view illustrating a state in which the drain box and the cabinet are separated.

FIG. 10 is a perspective view of the cabinet 11 constituting the entrance refrigerator 10, according to an embodiment, FIG. 11 is a partial perspective view illustrating the bottom surface of the cabinet 11 on which a drain box is mounted, and FIG. 12 is a partial perspective view illustrating a state in which the drain box and the cabinet 11 are separated.

The cabinet 11 may include a first portion 112 (exterior portion) inserted through the front door 1 or the wall, and a second portion 113 (interior portion) exposed to the inside.

The lower end of the second portion 113 may extend downward further than the lower end of the first portion 112. In detail, the front surface of the second portion 113 extending downward from the rear end of the bottom of the first portion 112 may be defined as a door contact surface 114. Like the front surface of the housing 15, the door contact surface 114 prevents the entrance refrigerator 10 from being separated from the front door 1 or the wall by the moment.

A contact shoulder 115 may be formed at a point spaced apart rearward from the front end of the cabinet 11 by a predetermined distance.

The contact shoulder 115 may protrude from the inner circumferential surface of the cabinet 11 by a predetermined height, and may have a rectangular band shape extending along the inner circumferential surface of the cabinet 11.

A rectangular opening defined along the inner edge of the contact shoulder 115 may define an inlet portion for goods entering or exiting the storage compartment 111.

A space between the front end of the cabinet 11 and a front surface of the contact shoulder 115 may be defined as an outdoor side door accommodation portion into which the outdoor side door 12 is received.

In a state in which the outdoor side door 12 is closed, the outer gasket 21 is in close contact with the front surface of the contact shoulder 115 to prevent leakage of cold air from the storage compartment 111.

The longitudinal cross-section of the storage compartment 111 defined at the rear of the contact shoulder 115 may have the same size as the longitudinal cross-section of the inlet portion. That is, the bottom surface of the storage compartment 111 may be coplanar with the upper edge of the contact shoulder 115 extending from the inner circumferential surface of the bottom portion of the cabinet 11. The bottom surface of the storage compartment 111 may include the base plate 20.

In addition, the left and right side surfaces of the storage compartment 111 may be coplanar with the inner edges of the contact shoulder 115 extending from the left inner circumferential surface and the right inner circumferential surface of the cabinet 11, respectively.

Finally, the ceiling surface of the storage compartment 111 may be coplanar with the lower edge of the contact shoulder 115 extending from the inner circumferential surface of the upper end of the cabinet 11.

In summary, it can be understood that the inner circumferential surface of the storage compartment 111 is coplanar with the inner edges of the contact shoulder 115.

However, the present disclosure is not limited to the above configuration. For example, the bottom surface of the storage compartment 111 may be coplanar with the bottom surface of the outdoor side door accommodation portion.

In detail, the contact shoulder 115 may be described as including a lower shoulder 115*a*, a left shoulder 115*b*, a right shoulder (see FIG. 6), and an upper shoulder 115*c*, and the bottom surface (floor) of the storage compartment 111 may be designed to be lower than the upper edge of the lower shoulder 115*a*.

In addition, the left and right side surfaces of the storage compartment 111 may be designed to be wider than the inner edges of the left shoulder 115*b* and the right shoulder.

Finally, the upper surface (ceiling) of the storage compartment 111 may be designed to be higher than the lower edge of the upper shoulder 115*c*.

According to this structure, the width and height of the storage compartment 111 may be formed to be larger than the width and height of the inlet portion.

A slot 116 may be formed at the bottom of the cabinet corresponding to the bottom of the outdoor side door accommodation portion.

The point where the slot 116 is formed may be described as a point spaced a predetermined distance rearward from the front end of the cabinet 11, or a point spaced a predetermined distance forward from the front surface of the contact shoulder 115.

The slot 116 may be formed at a position closer to the contact shoulder 115 than to the front end of the cabinet 11. As the air that has a relatively high temperature and is discharged from the housing 15 rises, the air may be introduced into the outdoor side door accommodation portion of the cabinet 11 through the slot 116.

The air flowing through the slot 116 flows along the edge of the outer gasket 21 to evaporate any condensation that may form on the outer gasket 21.

In detail, an inwardly stepped portion 119 may be formed in the bottom surface of the cabinet 11 corresponding to the first portion 112 and in the front surface of the cabinet 11 corresponding to the second portion 113. The stepped portion 119 is enclosed by the guide plate 18, and an air flow passage 119*a* is formed between the guide plate 18 and the stepped portion 119. The lower end of the air flow passage 119*a* communicates with the inside of the housing 15, and the upper end of the air flow passage 119*a* is connected to the slot 116.

Due to this structure, the relatively high-temperature air discharged from the housing 15 moves along the air flow passage 119*a* and flows into the slot 116. The air flowing through the slot 116 flows along the edge of the outer gasket 21 to evaporate any condensation that may form on the outer gasket 21.

A mount plate seating portion 117 may be formed at a predetermined depth on the inner bottom surface of the cabinet 11, particularly on the bottom surface of the cabinet 11 corresponding to the second portion 113.

The seating shoulder 111*d* may have a stepped shape at each of the front surface and the rear surface of the mount plate seating portion 117. The seating shoulder 111*d* may include a front seating shoulder and a rear seating shoulder.

The front seating shoulder may have a stepped shape extending from the bottom surface of the mount plate seating portion 117 by a predetermined height and protruding forward from the front surface of the mount plate seating portion 117.

The rear seating shoulder may have a stepped shape extending from the bottom surface of the mount plate seating portion 117 by a predetermined height and protruding rearward from the rear surface of the mount plate seating portion 117.

A through-hole 118 is formed on the bottom surface of the mount plate seating portion 117.

The bottom surface of the mount plate seating portion 117 includes a left drain floor 111*e* formed at the left side of the through-hole 118, and a right drain floor 111*g* formed at the right side of the through-hole 118.

The mount plate 24 may be seated on the bottom of the mount plate seating portion 117. The bottom of the mount plate seating portion 117 is designed to be slanted in the same shape as the bottom of the mount plate 24, such that the bottom of the mount plate 24 is in close contact with the bottom of the mount plate seating portion 117.

That is, the left flow guide seating portion 241*a* of the mount plate 24 may be in close contact with the left drain floor 111*e*, and the right flow guide seating portion 241*b* may be in close contact with the right drain floor 111*g*.

A drain hole 111*f* may be formed in the bottom surface of the mount plate seating portion 117, and the center of the drain hole 111*f* may be placed on the same vertical line as the center of the drain hole 243 formed in the mount plate 24. The diameters of the two drain holes 111*f* and 243 may be formed to be the same.

In addition, the through-hole 242 of the mount plate 24 may be formed to have the same size as the through-hole 118 of the mount plate seating portion 117, and the centers of the through-hole 242 and the through-hole 118 may be placed on the same vertical line.

Figure 15:
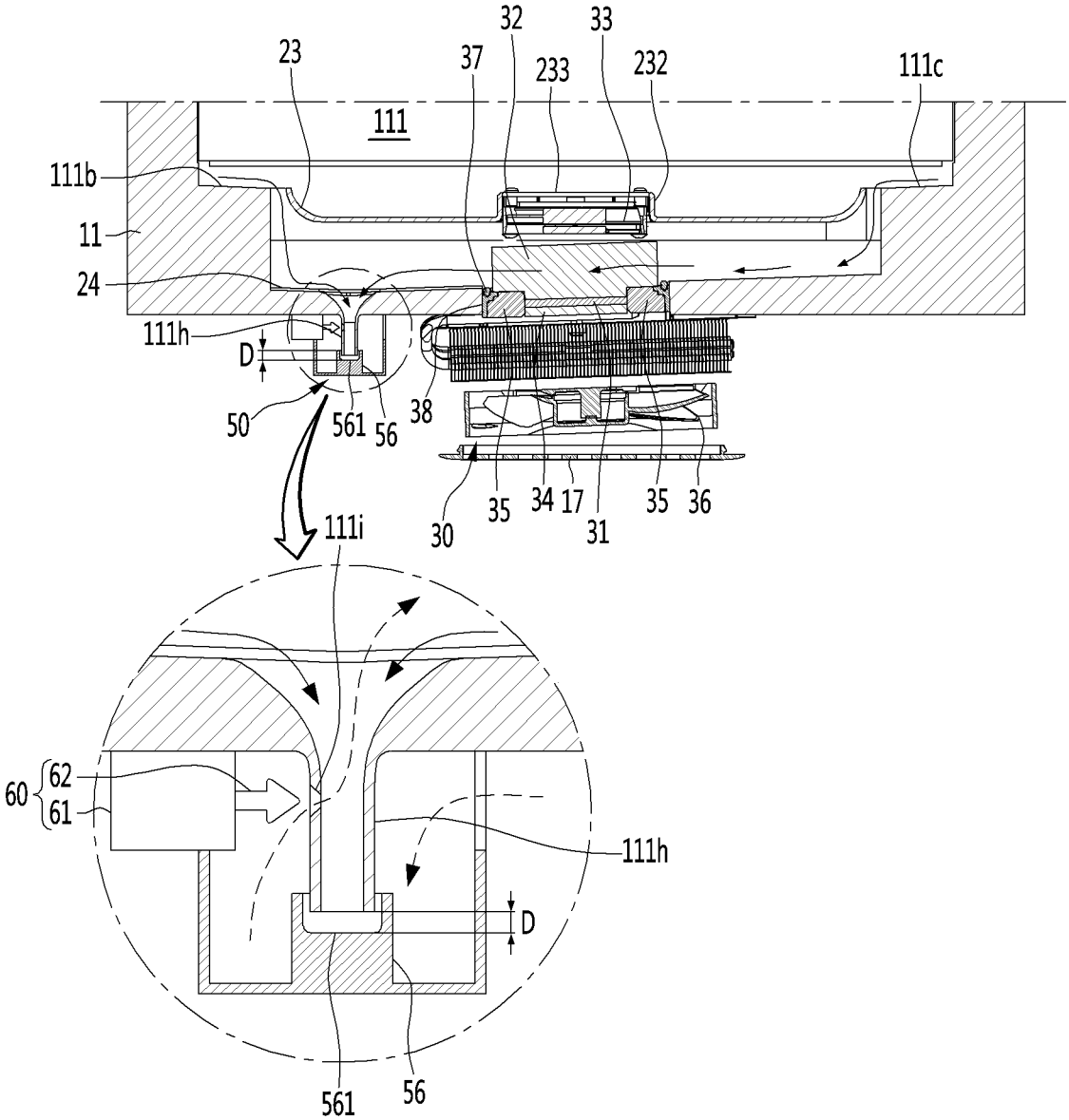
FIG. 15 is a partial longitudinal cross-sectional view of the entrance refrigerator, taken along line 15-15 of FIG. 10.

The bottom of the storage compartment 111, except for the mount plate seating portion 117, may include a front floor 111*a*, a left side floor 111*b*, and a right side floor 111*c* (see FIG. 15).

The front floor 111*a* is formed in front of the mount plate seating portion 117, and the left side floor 111*b* and the right side floor 111*c* are formed on the left and right sides, respectively, of the mount plate seating portion 117.

The bottom of the storage compartment 111 except for the mount plate seating portion 117, in other words, the front floor 111*a*, the left side floor 111*b* and the right side floor 111*c*, may be defined as a main floor, and the left drain floor 111*e* and the right drain floor 111*g* may be defined as a sub floor.

The front floor 111*a* may be formed to be slanted to be lowered toward the mount plate seating portion 117 from the front end, such that water falling on the front floor 111*a* flows down toward the mount plate seating portion 117.

Similarly, the left side floor 111*b* and the right side floor 111*c* may also be designed to be slanted to be lowered toward the mount plate seating portion 117, such that water falling on the left side floor 111*b* and the right side floor 111*c* flows down toward the mount plate seating portion 117.

The cold air supply device 30 passes through the through-holes 118 and 242 such that the upper portion of the cold air supply device 30 is partially exposed to the storage compartment and the lower portion of the cold air supply device 30 is partially exposed to the inside of the housing 15.

As shown in FIG. 12, a drain port 111*h* may protrude downward from the outer bottom surface of the cabinet 11 by a predetermined length. An upper opening of the drain port 111*h* communicates with the drain hole 111*f* formed in the bottom of the mount plate seating portion 117.

In addition, a drain box 50 is mounted on the outer bottom surface of the cabinet 11 to store water discharged from the drain port 111*h*.

In addition, one side of the side surface of the drain port 111*h* may be opened, and an actuator 60 which selectively opens or closes the opened portion may be disposed below the cabinet 11. The actuator 60 may be accommodated inside the housing 15 and does not necessarily need to be attached to the bottom of the cabinet 11. The actuator 60 and the opening portion of the drain port 111*h* opened or closed by the actuator 60 will be described below in more detail with reference to the drawings.

Hereinafter, the structure of the drain box 50 will be described with reference to the accompanying drawings.

Figure 13:
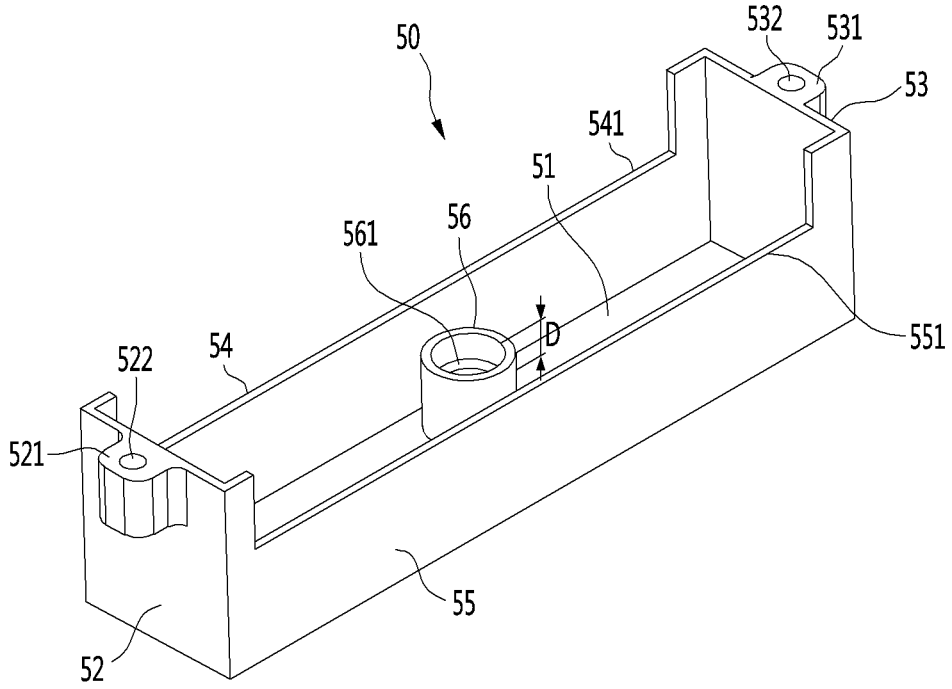
FIG. 13 is a perspective view of the drain box of the entrance refrigerator, according to an embodiment.

FIG. 13 is a perspective view of the drain box 50 of the entrance refrigerator 19, according to an embodiment.

Referring to FIG. 13, the drain box 50 may be formed in a hexahedral shape in which portions of the upper surface and the side surfaces thereof are opened, but the present disclosure is not necessarily limited thereto.

The drain box 50 may include a bottom portion 51, a front portion 52, a rear portion 53, a left side portion 54, a right side portion 55, and an upper portion that is opened.

A short side of the bottom portion 51 may be defined as a width, and a long side of the bottom portion 51 may be defined as a length.

The front portion 52 extends upward from a front end of the bottom portion 51 by a predetermined height, and a fastening rib 521 protrudes from the outer peripheral surface of the upper end thereof. A fastening hole 522 is formed in the fastening rib 521.

The rear portion 53 extends upward from a rear end of the bottom portion 51 by a predetermined height, and a fastening rib 531 protrudes from the outer peripheral surface of the upper end thereof. A fastening hole 532 is formed in the fastening rib 531.

The upper ends of the front portion 52 and the rear portion 53 may be on the same plane and may come in close contact with the bottom surface of the cabinet 11.

The left side portion 54 may extend upward from the left end of the bottom portion 51 by the same height as the front portion 52. A left recessed portion 541 may be formed in the left side portion 54 to be recessed downwardly by a predetermined depth.

The right side portion 55 may extend upward from the right end of the bottom portion 51 by the same height as the left side portion 54. A right recessed portion 551 may be formed in the right side portion 55 to be the same size as the left recessed portion 541.

The left recessed portion 541 and the right recessed portion 551 may be understood as portions of a flow passage of air flowing toward the side end of the housing 15 due to the heat dissipation fan 36. That is, the left recessed portion 541 and the right recessed portion 551 may be understood as being provided to prevent the flow of air forcedly flowing due to the heat dissipation fan 36 from being disturbed by the drain box 50.

In addition, the air passing through the left recessed portion 541 and the right recessed portion 551 is in a state in which the temperature is raised due to exchanging heat with the heat sink 34. Therefore, the high-temperature air flowing across the drain box 50 is discharged to the outside of the housing 15 in a state in which the humidity is increased by evaporating the condensed water stored in the drain box 50.

A port receiver 56 may protrude upward from the bottom portion 51 by a predetermined height. A recessed portion 561 recessed from the upper end of the port receiver 56 by a predetermined depth D may be formed in the port receiver 56.

The end portion of the drain port 111*h* extending from the bottom surface of the cabinet 11 is accommodated in the recessed portion 561. Therefore, the condensed water discharged from the drain port 111*h* falls into the recessed portion 561, and the condensed water that overflows from the recessed portion 561 is collected in the main portion of the drain box 50 defined by the bottom portion 51, the front portion 52, the rear portion 53, the left side portion 54, and the right side portion 55.

Since the end portion of the drain port 111*h* is kept submerged in the condensed water filled in the recessed portion 561, the occurrence of air flowing from the housing 15 into the storage compartment 111 through the drain port 111*h* may be prevented.

A device for draining the condensed water collected in the drain box 50 may be further provided.

For example, a drain hose may be provided at one side of the bottom portion 51, and the drain hose may extend outward from the housing 15. Alternatively, a drain pump may be attached to one side of the drain box 50, and a drain hose may extend from the drain pump to the outside of the housing 15.

As another method, an opening/closing port may be formed on the rear surface of the housing 15, that is, the opposite side of the surface in close contact with the front door 1, and the drain box 50 may be slidably withdrawn from the housing through the opening/closing port. With such an arrangement, the lower end of the drain port 111*h* is spaced apart from the upper end of the port receiver 56.

The drain box 50 may be mounted on the bottom surface of the cabinet 11 so as to be slidably movable in the front-to-rear direction of the cabinet 11, and a protective cover may be rotatably mounted on the opening/closing port.

In other words, an accommodation box for accommodating the drain box 50 may be provided on the bottom surface of the cabinet 11 exposed to the internal space of the housing 15, and a drawer structure in which the drain box 50 is slidably inserted into the accommodation box may be provided.

Figure 14:
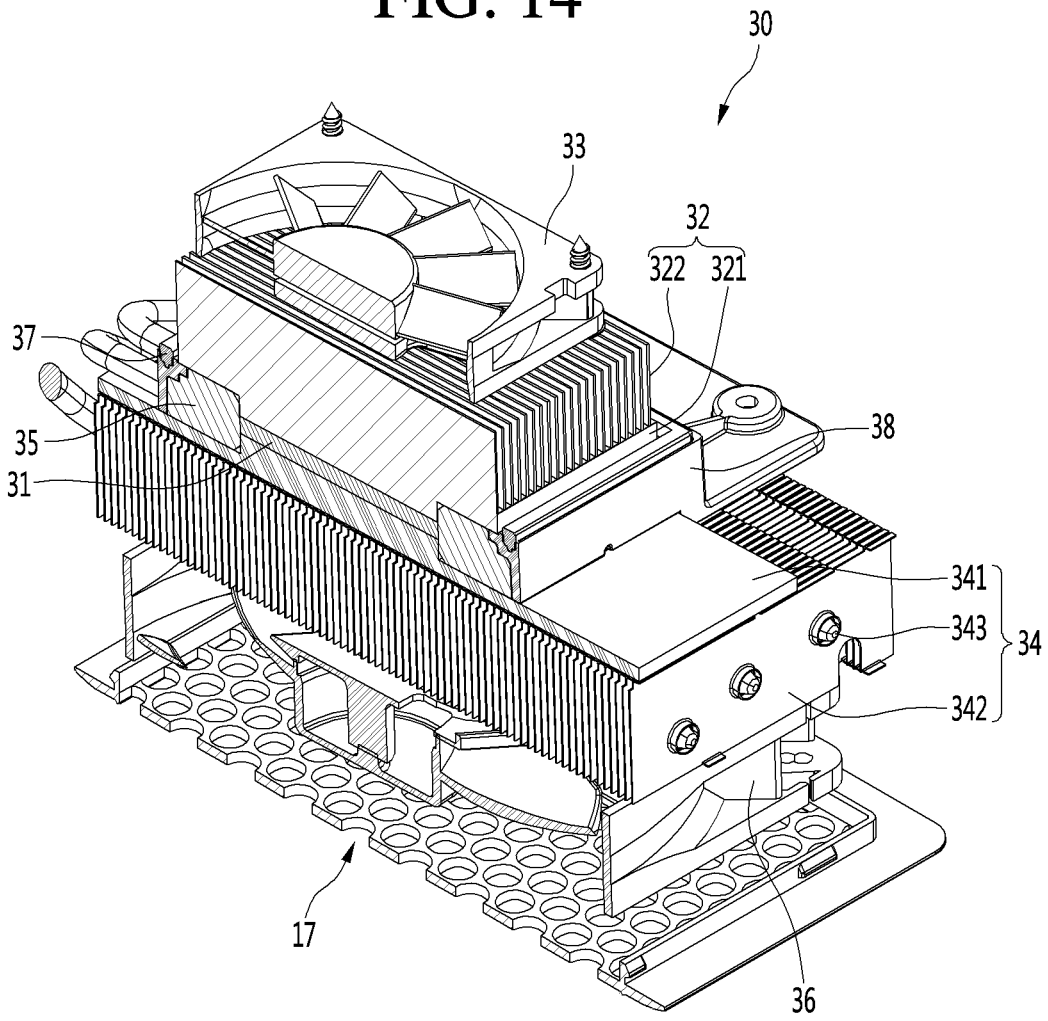
FIG. 14 is a cutaway perspective view of a cold air supply device of the entrance refrigerator, according to an embodiment.

FIG. 14 is a cutaway perspective view of the cold air supply device 30 of the entrance refrigerator 10, according to an embodiment.

The cold air supply device 30 illustrated in FIG. 14 is a cold air supply device 30 that is cut by a vertical plane extending in the horizontal direction such that a front portion thereof is removed.

Referring to FIG. 14, the cold air supply device 30 according to the embodiment may include a thermoelectric element 31, a cold sink 32 attached to the heat absorbing surface of the thermoelectric element 31, a heat absorption fan 33 disposed in front of (or above) the cold sink 32, a heat sink 34 attached to the heat generating surface of the thermoelectric element 31, a heat dissipation fan 36 disposed behind (or below) the heat sink 34, and an insulation material 35 for preventing heat transfer between the cold sink 32 and the heat sink 34.

The insulation material 35 is provided to surround the side surface of the thermoelectric element 31. The cold sink 32 is in contact with the front surface of the insulation material 35, and the heat sink 34 is in contact with the rear surface of the insulation material 35.

In addition, the cold sink 32 and the heat sink 34 may include a thermal conductor directly attached to the heat absorbing surface or the heat generating surface, respectively, of the thermoelectric element 31, and a plurality of heat exchange fins extending from the surface of the thermal conductor.

The heat absorption fan 33 is disposed to face the inside of the cabinet 11, and the heat dissipation fan 36 is disposed directly above the suction plate 17.

The cold sink 32 includes a sink body 321 in direct contact with the heat absorbing surface of the thermoelectric element 31, and a plurality of heat exchange fins 322 arranged on the upper surface of the sink body 321. The sink body 321 may include a first portion in direct contact with the heat absorbing surface of the thermoelectric element 31, and a second portion formed on the upper surface of the first portion and having an area larger than that of the first portion.

The heat sink 34 includes a sink body 341 in direct contact with the heat generating surface of the thermoelectric element 31, and a plurality of heat exchanger fins 342 arranged on the bottom surface of the sink body 341 and connected with the sink body 341 by a plurality of heat pipes 343. The sink body 341 may include a first portion in direct contact with the heat generating surface of the thermoelectric element 31, and a second portion formed on the bottom surface of the first portion and having an area larger than that of the first portion.

The insulation material 35 may be interposed between the second portion of the cold sink 32 and the second portion of the heat sink 34. The insulation material 35 may have a rectangular band shape.

The components of the cold air supply device 30 except for the heat absorption fan 33 and the heat dissipation fan 36 may be defined as a thermoelectric module. The heat absorption fan 33 may be fixedly coupled to the fan housing of the flow guide 23, and the heat dissipation fan 36 may be fixedly coupled to the suction plate 17 or the lower side of the thermoelectric module by one or more fastening screws.

A fastening bracket 38 may be coupled to the outer circumferential surface of the insulation material 35. The fastening bracket 38 may be understood as a mounting member that allows the thermoelectric module to be fixedly mounted on the bottom surface of the cabinet 11.

A sealing member 37 may surround the upper surface of the fastening bracket 38. The sealing member 37 is in close contact with the edge of the through-hole 118 formed in the bottom of the cabinet 11. Therefore, the sealing member 37 prevents the air inside the storage compartment 111 from leaking to the internal space of the housing 15.

Figure 16:
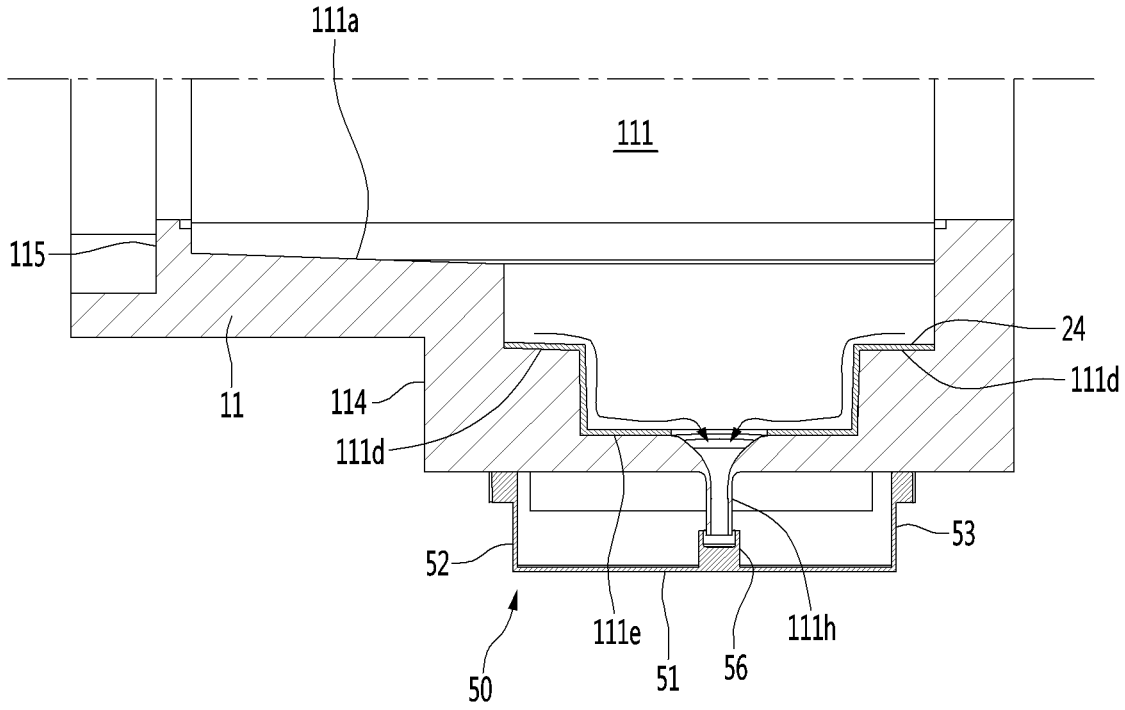
FIG. 16 is a partial longitudinal cross-sectional view of the entrance refrigerator, taken along line 16-16 of FIG. 10.

FIG. 15 is a partial longitudinal cross-sectional view of the entrance refrigerator 10, taken along line 15-15 of FIG. 10, and FIG. 16 is a partial longitudinal cross-sectional view of the entrance refrigerator 10, taken along line 16-16 of FIG. 10.

Referring to FIGS. 10, 15, and 16, there is a need for a drain structure that collects water, falling on the bottom of the storage compartment 111 or water formed on the surface of the cold sink 32 of the cold air supply device 30, in one place, and discharges the water to the outside of the storage compartment 111.

To achieve this purpose, the bottom surface of the storage compartment 111 may be slanted to one side.

The inner bottom surface of the cabinet 11 forming the bottom of the storage compartment 111 may include the front floor 111*a*, the left side floor 111*b*, and the right side floor 111*c*.

When the rear end of the mount plate seating portion 117 has a structure that is spaced forward from the rear end of the storage compartment 111, the surface defined as the seating shoulder 111*d* may also be formed on the rear side of the bottom surface of the storage compartment 111.

The bottom surface of the storage compartment 111 may be designed to be slanted to be lowered toward the mount plate seating portion 117. According to this structure, all the water falling on the bottom of the storage compartment 111 flows down along the edge of the mount plate seating portion 117.

In addition, the water flowing along the edge of the mount plate seating portion 117 flows to the upper surface of the mount plate 24 disposed on the mount plate seating portion 117.

The drain hole 243 (see FIG. 9) is formed in the flow guide seating portion 241 of the mount plate 24, and the flow guide seating portion 241 is formed to be slanted downward toward the drain hole 243. Thus, the water flowing onto the mount plate 24 is discharged through the drain hole 243.

In addition, the water falling on the right flow guide seating portion 241*b* formed on the right side of the through-hole 242 of the mount plate 24 flows toward the left flow guide seating portion 241*a* along the upper surface of the sink body 321 of the cold sink 32. To this end, the upper surface of the left end of the sink body 321 and the upper surface of the right end of the sink body 321 may be designed to form the same surface as the right edge of the left flow guide seating portion 241*a* and the left edge of the right flow guide seating portion 241*b*, respectively.

As another method, as described above, the drain hole 243 may be formed in the right flow guide seating portion 241*b*. That is, the left flow guide seating portion 241*a* and the right flow guide seating portion 241*b* may be symmetrical with respect to the vertical plane that divides the through-hole 242 from left and right.

The thermoelectric module may be mounted to be slanted with respect to the cabinet 11, as shown in FIG. 15, such that the water formed on the surface of the cold sink 32 flows toward the drain hole 243 of the mount plate 24 along the upper surface of the sink body 321 of the cold sink 32.

In detail, at least the left edge of the sink body 321 of the cold sink 32 is coupled below the right edge, such that the water flowing down on the upper surface of the sink body 321 flows toward the drain hole 243.

With this arrangement, the upper surface of the sink body 321 and the upper surface of the right flow guide seating portion 241*b* of the mount plate 24 form a single slanted surface, such that the water falling on the right flow guide seating portion 241*b* flows along the upper surface of the sink body 321 and flows to the drain hole 243. Alternatively, the thermoelectric module may be coupled to the cabinet such that the right edge of the sink body 321 is lower than the left edge of the right flow guide seating portion 241*b*, and the right edge of the left flow guide seating portion 241*a* is lower than the left edge of the sink body 321.

Since the left flow guide seating portion 241*a* of the mount plate 24 is formed along contours of the left drain floor 111*e*, the bottom surface of the left flow guide seating portion 241*a* of the mount plate 24 may be in close contact with the upper surface of the left drain floor 111*e*.

Similarly, since the right flow guide seating portion 241*b* of the mount plate 24 is also formed along contours of the right drain floor 111*g*, the bottom surface of the right flow guide seating portion 241*b* of the mount plate 24 may be in close contact with the upper surface of the right drain floor 111*g*.

Although the right end of the upper surface of the cold sink 32 is illustrated as being higher than the upper left end of the cold sink 32, the upper left end may be designed to be higher than the right end of the upper surface, if the drain port 111*h* is provided in the right drain floor 111*g*.

The drain hole 111*f* is formed in the lower drain floor at the bottom surface of the mount plate seating portion 117.

The drain floor adjacent to the higher side end of the cold sink 32 may be defined as a first drain floor, and the drain floor adjacent to the lower side end may be defined as a second drain floor.

As illustrated in FIG. 15, the heat absorption fan 33 may be horizontally coupled to the fan housing 232 of the flow guide 23 to be oriented horizontally and parallel to a ground surface (i.e. level).

In FIG. 15, the heat dissipation fan 36 is illustrated as being slantingly coupled to the lower side of the thermoelectric module at an angle non-parallel with respect to the ground surface (i.e. non-level), but the present disclosure is not limited thereto. For example, the heat dissipation fan 36 may be horizontally coupled to the lower side of the thermoelectric module to be oriented horizontally parallel to the ground surface (i.e. level) like the heat absorption fan 33.

The drain port 111*h* may be used as a passage for supplying outside air to the storage compartment 111.

When an animal is trapped inside the storage compartment 111, the outside air should be supplied to the storage compartment 111. In order to supply the outside air, an air hole 111*i* may be formed in the drain port 111*h*.

The air hole 111*i* may be formed at a point between the upper end and the lower end of the drain port 111*h*, and the air hole 111*i* may be selectively opened or closed by the actuator 60.

The actuator 60 may include a driver 61 and a plunger 62 connected to the driver 61 to move forward or backward from the driver 61 toward the air hole 111*i*.

The driver 61 may be a motor and a gear assembly which rotates by receiving rotational force of the motor, and a rack gear may be formed on the outer circumferential surface of the plunger 62 to engage with the gear assembly.

With this structure, when power is supplied to the driver 61, the gear assembly rotates and the plunger 62 geared to the gear assembly moves. When a forward voltage is applied to the driver 61, the motor rotates forward, and when a reverse voltage is applied to the driver, the motor rotates reversely, such that the plunger 62 connected to the gear assembly moves forward or backward.

The end portion of the plunger 62 may be provided with a conical head portion such that the air hole 111*i* is closed. The conical head portion acts as a stopper to plug the air hole 111*i*.

As another example, the driver 61 may be a solenoid which generates electromagnetic force when a current is applied thereto, such that the plunger 62 moves forward or backward. The driver 61 may include a spring to restore the plunger 62 to its original position when the current is no longer applied to the driver 61.

A carbon dioxide sensor 41*b* which detects a concentration of carbon dioxide may be mounted inside the storage compartment 111.

When the concentration of carbon dioxide detected by the carbon dioxide sensor 41*b* rises above a set value, a controller 41*a* of the entrance refrigerator 10 may determine that a living organism is present in the storage compartment 111. When the living organism is detected, the controller 41*a* may allow power to be supplied to the driver 61.

In a state in which there is no living organism inside the storage compartment 111, the plunger 62 keeps the air hole 111*i* closed to prevent outside air from flowing into the storage compartment 111.

The outside air introduced through the air hole 111*i* is air inside the housing 15, that is, indoor air having a high temperature by heat exchange with the heat sink 34. Therefore, in order to maintain the internal temperature of the storage compartment 111 at a set temperature, outside air is not introduced through the air hole 111*i* under normal conditions.

However, when it is determined that the detection value transmitted from the carbon dioxide sensor 41*b* to the controller 41*a* of the entrance refrigerator 10 is greater than or equal to the set value, power is supplied to the driver 61. The driver 61 may be driven such that the plunger 62 moves backward to open the air hole 111*i*.

As another method, a motion sensor 41*c* which detects a movement of an object inside the storage compartment 111 is provided inside the storage compartment 111. When the movement of the object such as a living organism is detected from the motion sensor 41*c*, the controller 41*a* supplies power to the actuator 60 such that the air hole 111*i* is opened.

The motion sensor 41*c* may include a PIR sensor, but the present disclosure is not limited thereto.

Figure 17:
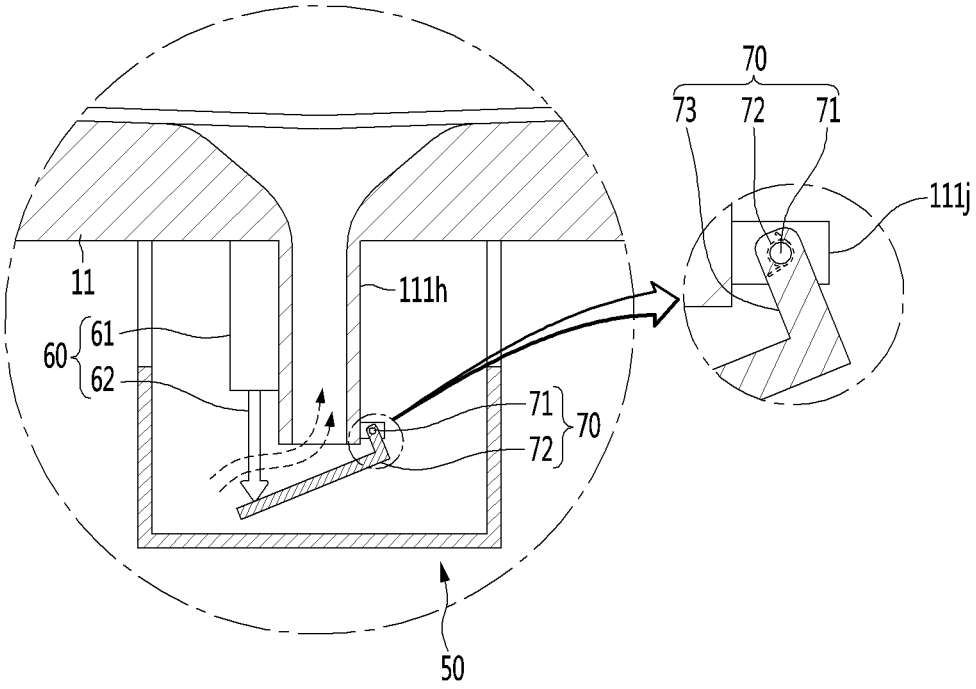
FIG. 17 is a partial longitudinal cross-sectional view of the entrance refrigerator, taken along line 15-15 of FIG. 10, showing an air hole opening/closing structure according to an embodiment.

FIG. 17 is a partial longitudinal cross-sectional view of the entrance refrigerator, taken along line 15-15 of FIG. 10, showing an air hole opening/closing structure according to an embodiment.

Referring to FIG. 17, the air hole opening/closing structure according to this embodiment may include an actuator 60 which is the same as that described with reference to FIG. 15, and a drain cover 70 rotatably coupled to the lower end of the drain port 111*h*.

In detail, the actuator 60 may be the same actuator as that described with reference to FIG. 15. The actuator 60 includes a driver 61 and a plunger 62. When power is supplied to the driver 61, the plunger 62 moves in the vertical direction.

The drain cover 70 coupled to the lower end of the drain port 111*h* may include a shielding plate 72 which shields a condensed water discharge port formed in the lower end of the drain port 111*h*, and a hinge shaft 71 formed at one end of the shielding plate 72.

A shaft connection portion 111*j* protrudes from the outer circumferential surface of the end portion of the drain port 111*h*. The hinge shaft 71 may be inserted into the shaft connection portion 111*j* after passing through one end of the shielding plate 72.

In order to avoid interference between the drain cover 70 and the drain port 111*h*, the end portion of the shielding plate 72 is bent, and the hinge shaft 71 passes through the bent end portion of the shielding plate 72. That is, the shielding plate 72 may be bent in an "L" shape.

As another method, the shaft connection portion 111*j* may be bent in a "b" shape, and the shielding plate 72 may be formed of a flat disk or a polygonal plate.

A torsion spring 73 may be wound around the hinge shaft 71. When no external force is applied to the shielding plate 72, the shielding plate 72 may be maintained in close contact with the end portion of the drain port 111*h* by the elastic force of the torsion spring 73.

When the load of the condensed water flowing into the drain port 111*h* is greater than the elastic force of the torsion spring 73 in a state in which the shielding plate 72 closes the drain port 111*h*, the shielding plate 72 rotates downward such that the condensed water discharge port of the drain port 111*h* is opened.

The drain port 111*h* is opened only at the time when the condensed water is discharged to the drain box 50. While the drain port 111*h* is opened, outside air is barely introduced into the storage compartment 111 as the condensed water is discharged through the drain port 111*h*. Therefore, a structure such as the port receiver 56 may not be required.

With this structure, the actuator 60 may be disposed on the side of the drain port 111*h* to press the shielding plate 72 such that the drain port 111*h* is forcibly opened.

In other words, in a state in which the load of the condensed water collected in the drain port 111*h* does not exceed the elastic force of the torsion spring 73, when the motion sensor 41*c* or the carbon dioxide sensor 41*b* detect that the living organism is present inside the storage compartment 111, the controller 41*a* supplies power to the driver 61.

Then, the plunger 62 moves downward to press the shielding plate 72 downward, and the shielding plate 72 rotates downward to open the condensed water discharge port of the drain port 111*h*.

At the same time, the elastic restoring force is accumulated in the torsion spring 73. Therefore, when the supply of power is cut off or the reverse voltage is supplied to the driver 61, the plunger 62 moves upward, and the shielding plate 72 shields the condensed water discharge port of the drain port 111*h* by the restoring force of the torsion spring 73.

With this structure, when no living organisms are present inside the storage compartment 111, outside air does not flow into the storage compartment 111 through the drain port 111*h*. However, when it is determined that the living organism is present, the drain port 111*h* is forcibly opened and outside air flows into the storage compartment 111, such that the companion animal does not die due to the lack of oxygen.

In addition, it is necessary to control the internal temperature of the storage compartment 111 with the forced opening of the drain port 111*h*, in order to prevent the companion animal trapped in the storage compartment from dying due to a low temperature in the storage compartment.

Even when the storage compartment 111 is in a warm storage mode, the companion animal may be placed in an environment higher than the companion animal's own body temperature and thus die.

Therefore, when the living organism is detected by the carbon dioxide sensor 41*b* or the motion sensor 41*c*, the controller 41*a* may control the driving of the actuator 60 and control the driving of the cold air supply device 30.

In detail, the controller 41*a* may control the amount of current supplied to the thermoelectric element 31 or the flow direction of current such that the internal temperature of the storage compartment 111 is maintained at a temperature most suitable for the survival of the companion animal.

For example, the controller 41*a* may adjust the amount of current supplied to the cold air supply device 30 and the flow direction of current such that the internal temperature of the storage compartment is maintained within a temperature range of 20° C. to 25° C., which is most suitable for the survival of the companion animal. In addition, upon detection of a living organism in the storage compartment 111, the controller 41*a* may control the guide light 131 to warn a user that a living organism is currently located in the entrance refrigerator 10.

The above-disclosed subject matter is to be considered illustrative, and not restrictive, and the appended claims are intended to cover all such modifications, enhancements, and other embodiments, which fall within the true spirit and scope of the present disclosure.

Thus, the technical spirit of the present disclosure is not limited to the foregoing embodiment.

Therefore, the scope of the present disclosure is defined not by the detailed description of the invention but by the appended claims, and all differences within the scope will be construed as being included in the present disclosure.

What is claimed is:

1. An entrance refrigerator, comprising:

a cabinet configured to extend through a door or a wall, the cabinet including a storage compartment therein for storing goods, the cabinet having a drain hole provided at a bottom of the storage compartment;

a housing located at a lower side of the cabinet;

an outdoor side door coupled to an outdoor portion of the cabinet to open or close the storage compartment;

an indoor side door coupled to an indoor portion of the cabinet to open or close the storage compartment;

a cold air supplier configured to supply cold air to the storage compartment, at least a portion of the cold air supplier extending through a bottom of the cabinet;

a drain port extending from a bottom side of the cabinet and communicating with the drain hole, the drain port having an air hole at a side surface thereof;

an actuator provided to selectively open or close the opening in the drain port; and a controller configured to:

control an operation of the cold air supplier; and control actuation of the actuator, wherein the actuator comprises:

a plunger configured to perform a linear reciprocating motion to selectively open or close the air hole; and a driver configured to provide a driving force to the plunger to perform the linear reciprocating motion, wherein the entrance refrigerator further comprises a drain box located below the cabinet to store condensed water discharged through the drain port, wherein the drain box includes a port receiver protruding upward from a bottom surface of the drain box, wherein an upper end of the port receiver includes a recessed portion in which the condense water is filled, and wherein a lower end of the drain port is disposed in the recessed portion.

2. The entrance refrigerator according to claim 1, wherein the driver comprises a solenoid.

3. The entrance refrigerator according to claim 1, further comprising a motion sensor located within the storage compartment.

4. The entrance refrigerator according to claim 1, further comprising a carbon dioxide sensor located within the storage compartment.

5. The entrance refrigerator according to claim 1, wherein the cold air supplier comprises:

a thermoelectric module at least partially located within a through-hole provided in the bottom of the cabinet;

a heat absorption fan located above the thermoelectric module to provide a flow of air within the storage compartment; and a heat dissipation fan located below the thermoelectric module to provide a flow of air within the housing, wherein the thermoelectric module comprises:

a thermoelectric element having a heat absorbing surface and a heat generating surface;

a cold sink in contact with the heat absorbing surface, the cold sink configured to be exposed to air in the storage compartment to exchange heat with the air in the storage compartment; and a heat sink in contact with the heat generating surface, the heat sink configured to be exposed to air in the housing to exchange heat with the air in the housing.

6. An entrance refrigerator, comprising:

a cabinet configured to extend through a door or a wall, the cabinet including a storage compartment therein for storing goods, the cabinet having a drain hole provided at a bottom of the storage compartment;

a housing located at a lower side of the cabinet;

an outdoor side door coupled to an outdoor portion of the cabinet to open or close the storage compartment;

an indoor side door coupled to an indoor portion of the cabinet to open or close the storage compartment;

a cold air supplier configured to supply cold air to the storage compartment, at least a portion of the cold air supplier extending through a bottom of the cabinet;

a drain port extending from a bottom side of the cabinet and communicating with the drain hole, the drain port having an opening therein;

an actuator provided to selectively open or close the opening in the drain port; and a controller configured to:

control an operation of the cold air supplier; and control actuation of the actuator, wherein the opening is a condensed water discharge port provided at a lower end of the drain port, and wherein the entrance refrigerator further comprises a drain cover rotatably provided at the lower end of the drain port to selectively open or close the condensed water discharge port.

7. The entrance refrigerator according to claim 6, wherein the drain cover comprises:

a shielding plate configured to close the condensed water discharge port; and a hinge shaft rotatably connecting one end portion of the shielding plate to the drain port.

8. The entrance refrigerator according to claim 7, wherein the shielding plate is rotated about the hinge shaft by the actuator, and wherein the condensed water discharge port is opened when the shielding plate is separated from the lower end of the drain port.

9. The entrance refrigerator according to claim 8, further comprising a torsion spring configured to provide an elastic restoring force to bias the shielding plate toward a closed position of the condensed water discharge port.

10. The entrance refrigerator according to claim 9, further comprising a drain box located below the cabinet to store condensed water discharged through the drain port, wherein the actuator and the drain port are accommodated in the drain box.

11. An entrance refrigerator, comprising:

a cabinet configured to extend through a door or a wall, the cabinet including a storage compartment therein for storing goods, the cabinet having a drain hole provided at a bottom of the storage compartment;

a housing located at a lower side of the cabinet;

an outdoor side door coupled to an outdoor portion of the cabinet to open or close the storage compartment;

an indoor side door coupled to an indoor portion of the cabinet to open or close the storage compartment;

a cold air supplier configured to supply cold air to the storage compartment, at least a portion of the cold air supplier extending through a bottom of the cabinet;

a drain port extending from a bottom side of the cabinet and communicating with the drain hole, the drain port having an opening therein;

an actuator provided to selectively open or close the opening in the drain port;

a controller configured to:

control an operation of the cold air supplier; and control actuation of the actuator; and a motion sensor located within the storage compartment, wherein the controller is further configured to:

receive a signal detecting a motion of a living organism within the storage compartment from the motion sensor; and control the actuator to open the opening in the drain port when motion is detected by the motion sensor.

12. An entrance refrigerator, comprising:

a cabinet configured to extend through a door or a wall, the cabinet including a storage compartment therein for storing goods, the cabinet having a drain hole provided at a bottom of the storage compartment;

a housing located at a lower side of the cabinet;

an outdoor side door coupled to an outdoor portion of the cabinet to open or close the storage compartment;

an indoor side door coupled to an indoor portion of the cabinet to open or close the storage compartment;

a cold air supplier configured to supply cold air to the storage compartment, at least a portion of the cold air supplier extending through a bottom of the cabinet;

a drain port extending from a bottom side of the cabinet and communicating with the drain hole, the drain port having an opening therein;

an actuator provided to selectively open or close the opening in the drain port;

a controller configured to:

control an operation of the cold air supplier; and control actuation of the actuator; and a carbon dioxide sensor located within the storage compartment, wherein the controller is further configured to:

receive a signal detecting carbon dioxide of a living organism within the storage compartment from the carbon dioxide sensor; and control the actuator to open the opening in the drain port when a concentration of carbon dioxide detected by the carbon dioxide sensor exceeds a set value.

13. A refrigerator, comprising:

a cabinet configured to be located partially within a barrier of a building, the cabinet including a storage compartment therein, the cabinet having a first opening into the storage compartment and a second opening into the storage compartment, the second opening being spaced from the first opening, the cabinet further having a drain hole provided at a bottom of the storage compartment;

a housing located at a lower side of the cabinet;

a first door coupled to the cabinet to open or close the first opening;

a second door coupled to the cabinet to open or close the second opening;

a cold air supplier configured to supply cold air to the storage compartment, at least a portion of the cold air supplier extending through a bottom of the cabinet;

a drain port extending from a bottom side of the cabinet and communicating with the drain hole, the drain port having an opening therein;

an actuator provided to selectively open or close the opening in the drain port; and a controller configured to:

control an operation of the cold air supplier; and control actuation of the actuator, wherein the actuator comprises:

a plunger configured to perform a linear reciprocating motion; and a driver configured to provide a driving force to the plunger to perform the linear reciprocating motion, wherein the entrance refrigerator further comprises a drain cover rotatably provided at the lower end of the drain port to selectively open or close the opening, wherein the drain cover comprises:

a shielding plate configured to close the opening; and a hinge shaft rotatably connecting one end portion of the shielding plate to the drain port, wherein the shielding plate is rotated about the hinge shaft by the actuator, and wherein the opening is opened when the shielding plate is separated from the lower end of the drain port.

* * * * *